US007756436B2

(12) United States Patent
Yamane

(10) Patent No.: US 7,756,436 B2
(45) Date of Patent: Jul. 13, 2010

(54) IMAGE FORMING APPARATUS WITH IMPROVED QUALITY ON IMAGE OF LOW DOT POPULATION

(75) Inventor: Tsutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 144 days.

(21) Appl. No.: 12/078,264

(22) Filed: Mar. 28, 2008

(65) Prior Publication Data

US 2008/0240764 A1 Oct. 2, 2008

(30) Foreign Application Priority Data

Mar. 29, 2007 (JP) ..... 2007-086864

(51) Int. Cl.
*G03G 15/00* (2006.01)
*G03G 15/08* (2006.01)

(52) U.S. Cl. ..... 399/71; 399/44; 399/257

(58) Field of Classification Search ..... 399/71, 399/257, 44, 53, 55, 273, 283
See application file for complete search history.

(56) References Cited

U.S. PATENT DOCUMENTS 5,512,981 A * 4/1996 Hirsch ..... 399/257 X
2003/0123907 A1* 7/2003 Nonaka et al. ..... 399/257
2006/0198644 A1* 9/2006 Itagaki et al. ..... 399/257 X
2007/0253742 A1* 11/2007 Maeshima et al. ..... 399/257
2008/0080876 A1* 4/2008 Facci et al. ..... 399/257 X

FOREIGN PATENT DOCUMENTS

JP 2003-162102 6/2003
JP 2004-045481 2/2004
JP 2006-091094 A * 4/2006
JP 2006-139111 A * 6/2006

* cited by examiner

*Primary Examiner*—Sophia S Chen
(74) *Attorney, Agent, or Firm*—Rabin & Berdo, P.C.

(57) ABSTRACT

A developing roller supplies toner to an image on an image bearing body, the image being formed in accordance with image data. A toner supplying member supplies developer material to the developer bearing member. A computing section computes a dot population density in corresponding one of a plurality of sub data areas. The plurality of sub data areas are obtained by dividing the image data such that the plurality of sub data areas are aligned in a printable area of a print medium in a direction perpendicular to the direction of travel of the print medium. A controller performs a developer material removing process based on the dot population density, in which the toner deposited on the developing roller is removed from the developing roller in an area corresponding to a low dot population density of image data.

17 Claims, 16 Drawing Sheets

IMAGE FORMING APPARATUS WITH IMPROVED QUALITY ON IMAGE OF LOW DOT POPULATION

BACKGROUND OF THE INVENTION

1. Field of the Invention

The present invention relates to an image forming apparatus.

2. Description of the Related Art

Conventional image forming apparatuses including printers, copying machines, facsimile machines, and multi function printers (MFPs) involve an electrophotographic process where charging, exposing, developing, transferring, and fusing are performed in sequence. A charging roller charges the surface of a photoconductive drum. A light emitting diode (LED) head illuminates the charged surface of the photoconductive drum to form an electrostatic latent image. A developing roller rotates in contact with the photoconductive drum to supply toner to the electrostatic latent image to form a toner image. After transfer of the toner image onto a print medium, the photoconductive drum is cleaned of residual toner by a cleaning unit.

Dot population density in the present invention may be represented in terms of the ratio of the number of printed dots in a printable area to a total number of dots printable in the printable area. If an image having a low dot population density is printed repeatedly, a large percentage of the toner deposited on the developing roller remains unconsumed, so that the toner remaining on the developing roller will eventually be deteriorated. For solving this drawback, if an image has a low dot population density, the toner remaining on the developing roller after the development of the image, the residual toner is intentionally transferred to the photoconductive drum and then the toner on the photoconductive drum is collected as waste toner.

An image may not be necessarily uniform in the dot population density over the entire printable area. Even if an image has a high dot population density only in a limited area within the printable area, the average dot population density over the printable area may be low. A conventional image forming apparatus suffers from a problem in that if an image has a high dot population density only in a limited area within the entire printable area, the residual toner may not be collected thoroughly from the photoconductive drum and the residual toner will eventually deteriorate on the photoconductive drum. This causes spoiled images or poor print quality.

SUMMARY OF THE INVENTION

The present invention was made in view of the aforementioned drawbacks of a conventional image forming apparatus.

An object of the invention is to provide an image forming apparatus in which the quality of an image is improved when the image has a low dot population.

An image forming apparatus includes a developing roller, a toner supplying member, a computing section, and a controller. The developing roller supplies the toner to an image on an image bearing body, the image being formed in accordance with image data. The toner supplying member supplies the developer material to the developer bearing member. The computing section computes a dot population density in corresponding one of a plurality of sub data areas. The plurality of sub data areas is obtained by dividing the image data such that the plurality of sub data areas are aligned in a printable area of a print medium in a direction perpendicular to a direction of travel of the print medium. The controller performs a developer material removing process based on the dot population density. The developer material removing process is such that the toner deposited on the developing roller is removed from the developing roller in an area corresponding to a low dot population density of image data.

The computing section computes the dot population density based on a number of printed dots in the corresponding one of the plurality of sub data areas and a number of printable dots in the corresponding one of the plurality of sub data areas.

The dot population density is the ratio of the number of printed dots to the number of printable dots.

An image forming apparatus includes an image bearing body, a developer bearing member, a developer supplying member, a computing section, and a controller. An image is formed on the image bearing body in accordance with image data. A first potential is applied to the developer bearing member. The developer bearing member supplies a developer material to the image bearing body to form a developer image. A second potential is applied to the developer supplying member. The developer supplying member supplies the developer material to the developer bearing member. The computing section computes a dot population density for a corresponding one of a plurality of sub data areas, the plurality of sub data areas being obtained by dividing the image data such that the plurality of sub data areas are aligned in a printable area of a print medium in a direction perpendicular to a direction of travel of the print medium. The controller decreases a potential difference between the first potential and the second potential based on the dot population density.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Overall Configuration}

Figure 1:
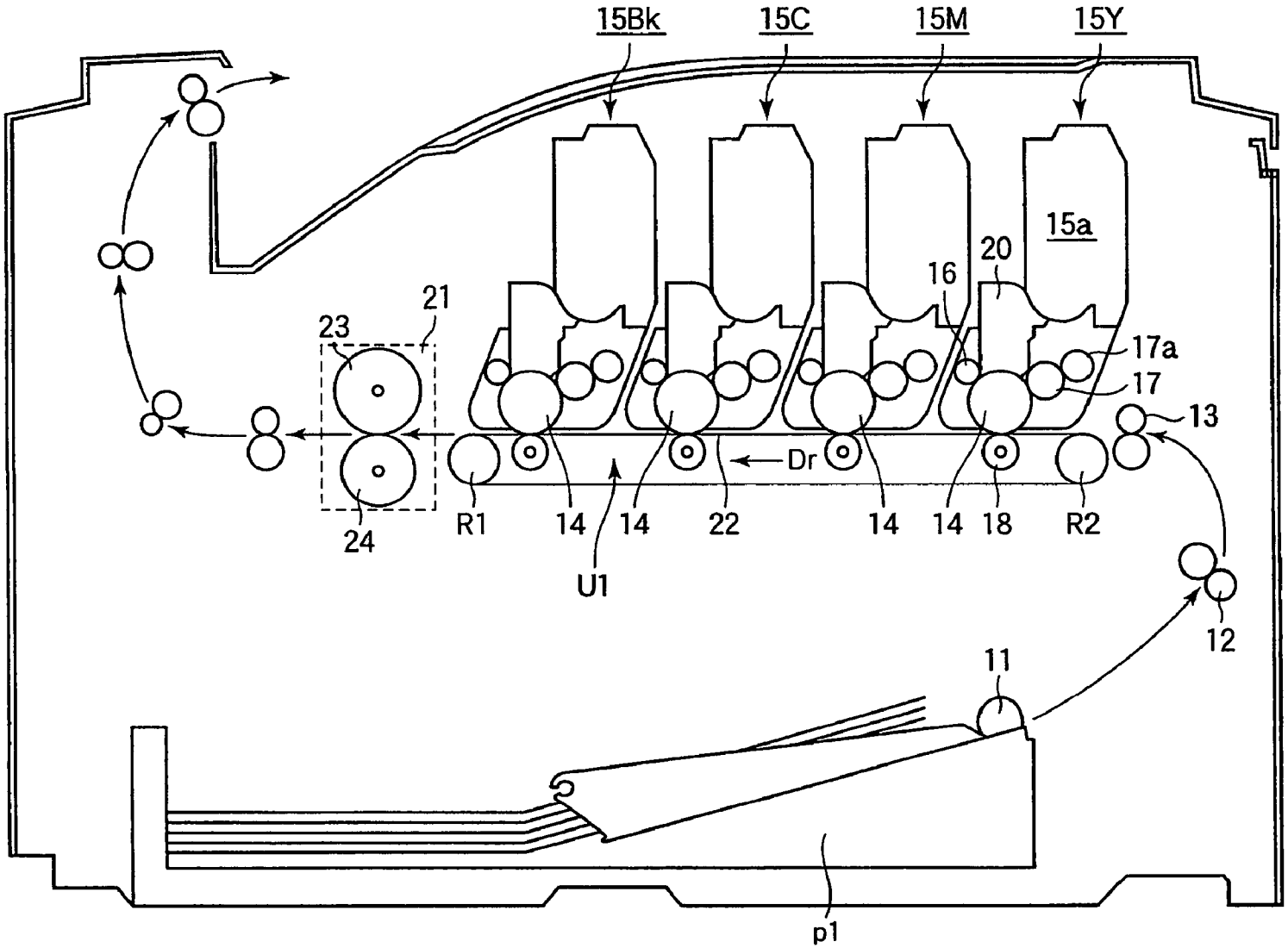
FIG. 1 illustrates a general configuration of the printer of a first embodiment.

The invention will be described in terms of a printer. FIG. 1 illustrates a general configuration of the printer of a first embodiment. Referring to FIG. 1, image forming sections 15Y, 15M, 15C, and 15BK are aligned side by side in a direction in which print paper is transported, and form yellow, magenta, cyan, and black images, respectively. Each of the image forming sections 15Y, 15M, 15C, and 15BK includes a photoconductive drum 14, a charging roller 16, a developing roller 17, a toner supplying roller 17*a*, a cleaning blade 25 (FIG. 2), and a toner cartridge 15*a* that holds toner (developer material). The charging roller 16 rotates in contact with the photoconductive drum 14 to charge the surface of the photoconductive drum 14.

A print head 20 extends in parallel to the photoconductive drum 14 and illuminates the charged surface of the photoconductive drum 14 to form an electrostatic latent image. The electrostatic latent image is a latent image of, for example, characters, figures, and graphics formed of dots.

The developing roller 17 supplies toner to the electrostatic latent image formed on the photoconductive drum 14 to form a toner image. The toner supplying roller 17*a* supplies the toner to the developing roller 17. The cleaning blade scrapes residual toner off the photoconductive drum 14. The toner cartridge 15*a* holds toner of a corresponding color. A developing unit primarily includes the developing roller 17 and the toner supplying roller 17*a*.

A belt unit U1 extends beneath the photoconductive drums 14 of the respective image forming sections 15Y, 15M, 15C, and 15BK. Transfer points are defined between the belt unit U1 and the respective photoconductive drums 14. The belt unit U1 includes an endless belt 22 looped on a drive roller R1 and a driven roller R2. The endless belt 22 runs in a direction shown by arrow Dr. The endless belt 22 is sandwiched between the photoconductive drum 14 and a transfer roller 18 at the respective image forming section.

A paper cassette P1 is disposed under the belt unit U1, and holds a stack of print paper. The paper cassette P1 includes a feed roller 11 that feeds a top page of the stack of print paper into a transport path. The print paper is transported by transport rollers 12 and 13, and passes through the respective image forming sections 15Y, 15M, 15C, and 15BK to a fixing unit 21. The fixing unit 21 includes a heat roller 23 and a pressure roller 24.

Electric power and control signals are supplied to the image forming sections 15Y, 15M, 15C, and 15BK in the same manner. The image forming sections are of substantially the same configuration and differ only in the color of image. For the sake of simplicity, a description will be given only of the image forming section 15Y.

Figure 2:
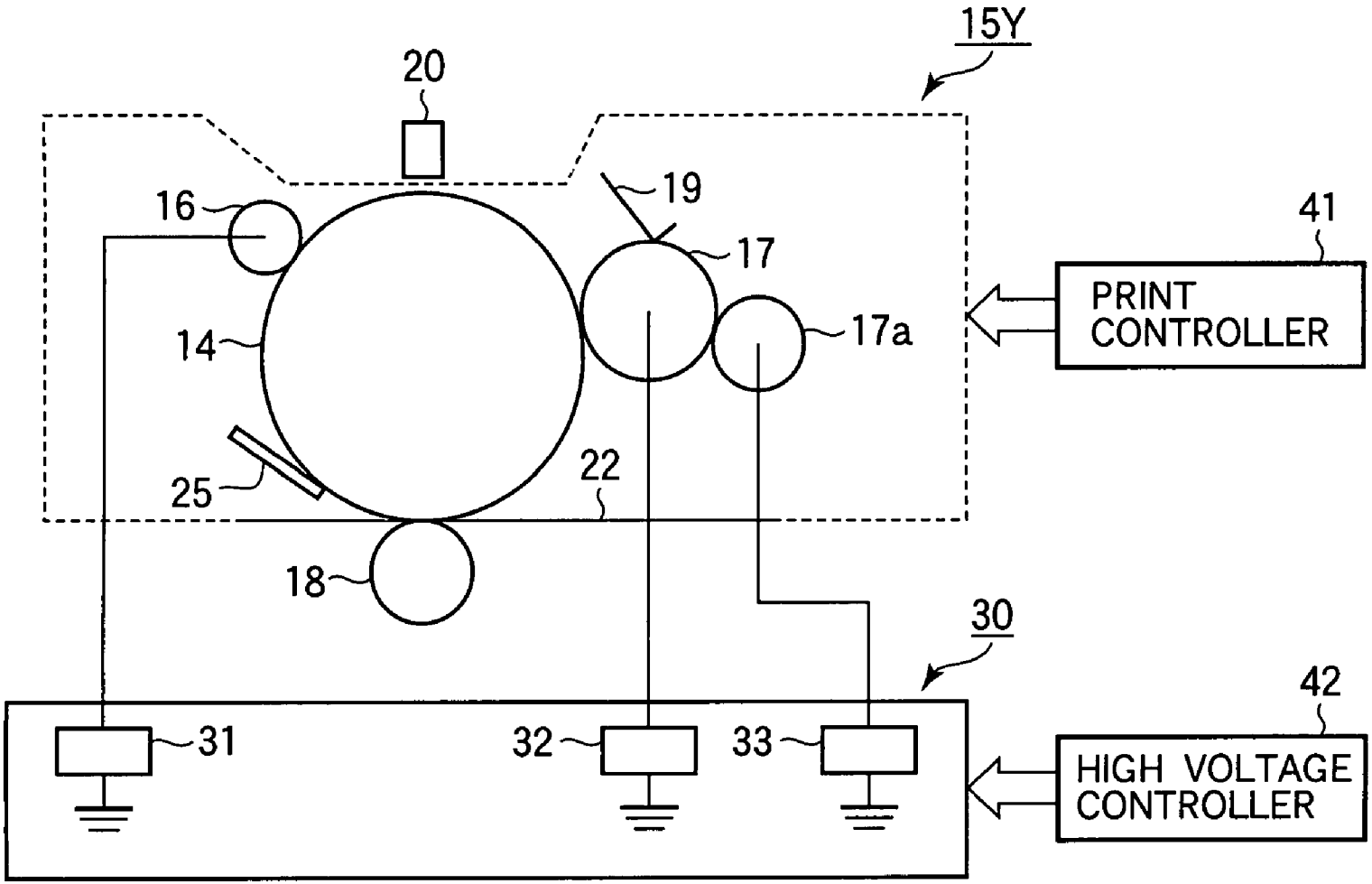
FIG. 2 illustrates an electrical system for the image forming section of the first embodiment.

FIG. 2 illustrates the electrical system for the image forming section 15Y of the first embodiment.

Referring to FIG. 2, the image forming section 15Y includes the photoconductive drum 14, the charging roller 16, the developing roller 17, the toner supplying roller 17*a*, a developing blade 19, and the cleaning blade 25. The print head 20 is disposed over the photoconductive drum 14, and the transfer roller 18 is below the photoconductive drum 14 with the endless belt 22 sandwiched between the photoconductive drum 14 and the transfer roller 18. A charging power supply 31, a developing power supply 32, and a toner supplying roller power supply 33 provide electric power to the charging roller 16, developing roller 17, and the toner supplying roller 17*a*, respectively.

A print controller 41 controls the speeds of the photoconductive drum 14, charging roller 16, developing roller 17, and toner supplying roller 17*a*. A voltage controller 41 controls the output voltages of the charging power supply 31, developing power supply 32 and toner supplying power supply 33. A power supply unit 30 includes the charging power supply 31, developing power supply 32, and toner supplying power supply 33.

The charging power supply 31 outputs a bias voltage of a polarity to which the toner should be charged. The developing power supply 32 outputs a bias voltage of a polarity to which the toner should be charged, or of a polarity opposite to the polarity to which the toner should be charged, depending on the operating state of the printer. The toner supplying power supply 33 outputs a bias voltage of a polarity to which the toner should be charged, or of a polarity opposite to the polarity to which the toner should be charged, depending on the operation state of the printer.

The photoconductive drum 14 is an organic photoconductive body and includes an aluminum hollow cylinder covered with a photoconductive layer. The photoconductive layer includes a charge generation layer and a charge transport layer. The photoconductive drum 14 has a diameter of, for example, 30 mm. The charging roller 16 includes a metal shaft covered with a semi conductive rubber material, e.g., semi conductive urethane rubber. The charging roller 16 has a diameter of, for example, 16 mm. The developing blade 19 is in the shape of a plate and has a thickness of, for example, 0.8 mm, and extends across the length of the developing roller 17. The developing blade 19 has one widthwise end secured to a frame of the image forming section 15Y and another widthwise end in pressure contact with the developing roller 17.

{Overall Controller}

Figure 3:
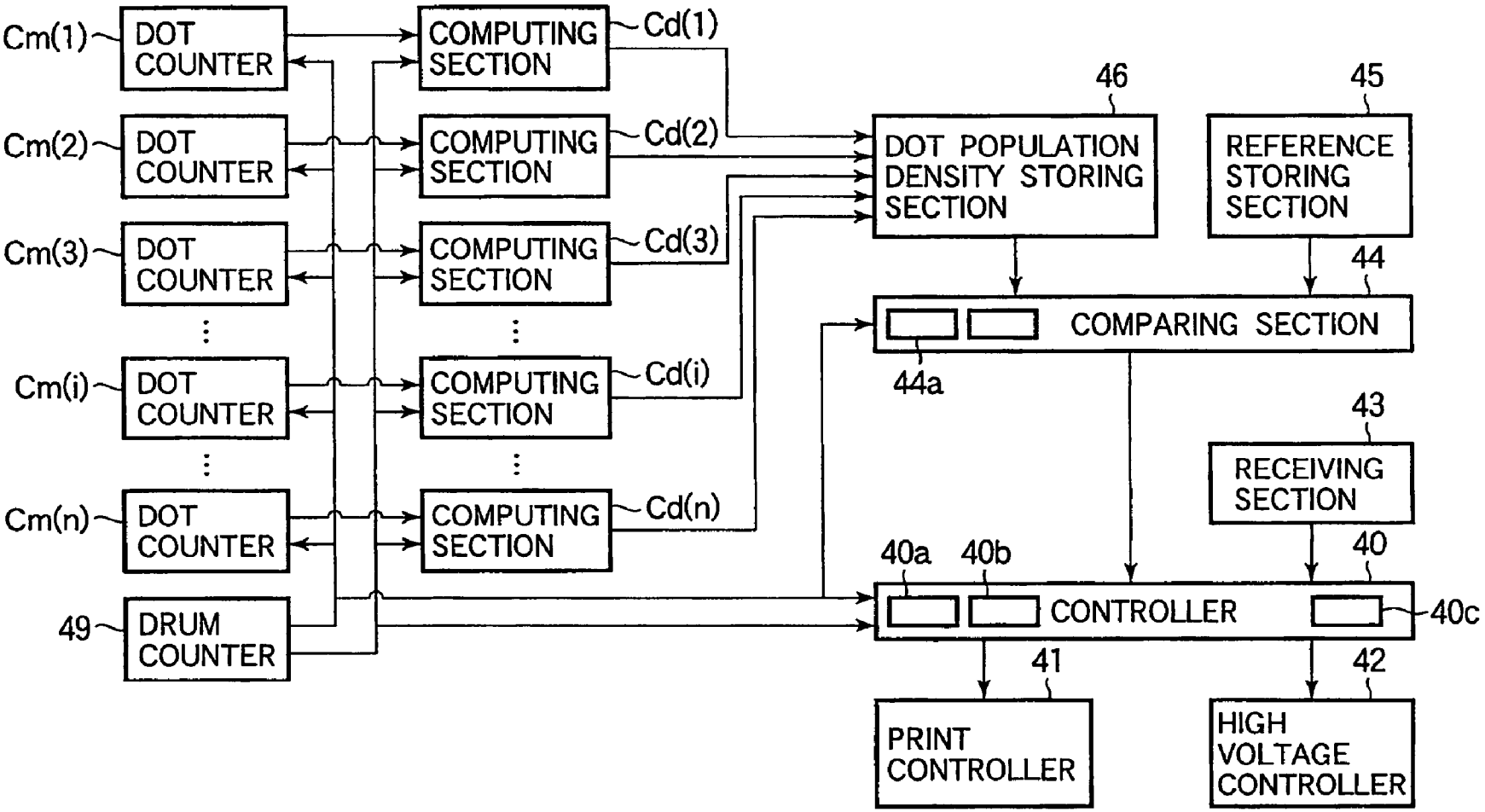
FIG. 3 is a block diagram illustrating an overall controller for the printer of the first embodiment.

FIG. 3 is a block diagram illustrating the overall controller for the printer of the first embodiment.

Referring to FIG. 3, the overall controller includes the controller 40, the print controller 41, a high voltage controller 42, a receiving section 43, a comparing section 44, a reference storing section 45, a dot population density storing section 46, dot counters Cm(1), Cm(2), Cm(3), . . . , Cm(i), . . . , Cm(n) (n is an integer), computing sections Cd(1), Cd(2), Cd(3), . . . , Cd(i), . . . , Cd(n), and a drum counter 49.

The controller 40 outputs commands to the respective image forming sections 15Y, 15M, 15C, and 15BK via the print controller 41, and commands to the respective power supplies 31, 32, and 33. The dot population density storing section 46 receives values of the dot population density from the computing sections Cd(1), Cd(2), Cd(3), . . . , Cd(i), . . . , Cd(n), and holds the values. The drum counter 49 counts the number of rotations of the photoconductive drum 14 (i.e., drum count A), and sends the drum count A to the respective computing sections Cd(1), Cd(2), Cd(3), . . . , Cd(i), . . . , Cd(n). The computation is performed at intervals of a predetermined time. It is to be noted that the photoconductive drum 14 for black image rotates at different rotational speeds for color printing and monochrome printing.

Dot population density may be the ratio of the number of printed dots in a printable area to a total number of dots that may be printed in the printable area. Thus, the dot population density is given by $$\text{Dot population density} = \frac{\sum dc}{Nd \times 100} \times 100\,(\%)$$

where Σdc is a total number of printed dots per 100 pages and Nd is a total number of dots that may be printed on one page.

The reference storing section 45 stores a reference density Dref and a threshold value P of the drum count A. The reference density Dref is a reference value of the dot population density, and is selected to be 3% in the first embodiment.

The comparing section 44 reads the reference density Dref and the dot population densities computed by the respective computing sections Cd(1), Cd(2), . . . , Cd(i), . . . , Cd(n), and then compares the reference density Dref with each of the computed dot population densities. The comparing section 44 also reads the threshold value P and the drum count A (i.e., number of rotations of photoconductive drum 14) counted by the drum counter 49, and compares the drum count A with the threshold value P. The receiving section 43 receives print data from a host apparatus, e.g., host computer.

{Operation of Printer}

The operation of the printer of the aforementioned configuration will be described.

The charging roller 16 charges the surface of the photoconductive drum 14 uniformly to a predetermined polarity and a potential. A write controller (not shown) generates image data from the print data received from the external host apparatus. The print head 20 receives image data from the write controller, and illuminates the charged surface of the photoconductive drum 14 in accordance with the image data to form an electrostatic latent image.

The toner supplying roller 17*a* rotates in contact with the developing roller 17 to supply the toner to the developing roller 17. The thickness of the toner layer formed on the developing roller 17 is determined by the pressure applied by the developing blade 19 on the developing roller 17.

The developing roller 17 rotates in contact with the photoconductive drum 14 to deposit the toner to the electrostatic latent image with the aid of the voltage applied by the high voltage controller 42 to the photoconductive drum 14, thereby forming a toner image. The toner image is then transferred onto the print paper by the electric field developed across the photoconductive drum 14 and the transfer roller 18. The print paper is then transported to the fixing unit 21 where the toner image is fused into a permanent image. The photoconductive drum 14 is cleaned of remaining toner by the cleaning blade 25.

Some print data may have images of a low dot population density for all colors. Other print data may have images of a high dot population density for a particular color. Consequently, an image of low dot population density consumes only small amounts of toner, and the toners in corresponding image forming sections continue to be agitated. Also, the toner particles continue to be rubbed by the toner supplying roller 17*a*, developing roller 17, and photoconductive drum 14. Due to continued triboelectrical charging, the toner on the developing roller 17 tends to be excessively charged, spoiling the printed images.

If the toner continues to be rubbed, the toner particles are subject to excessive friction, loosing the external additive from their surfaces. As a result, the toner may not be charged normally, causing spoiled images and soiling of print paper.

As described above, too low a dot population density prevents the toner from charging normally, causing soiling of print paper, spoiled images, and vague images.

In order to maintain consistent image quality, the dot population density is monitored. After printing a certain amount of images of low dot population density, the toners on the developing rollers 17 are discarded.

{Detecting Dot Population Density}

A description will be given of a method for determining whether an image has a low dot population density.

Figure 4:
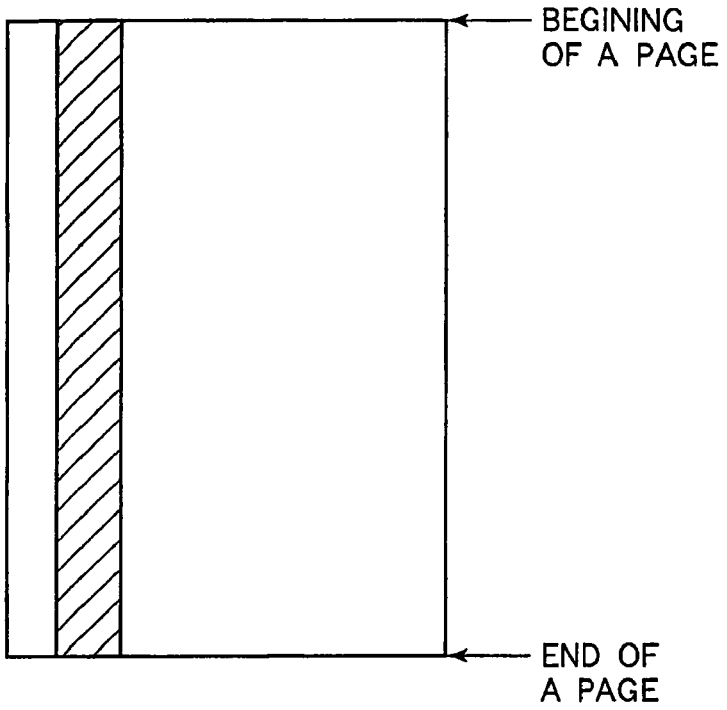
FIG. 4 illustrates an example of printing of the first embodiment.
Figure 5:
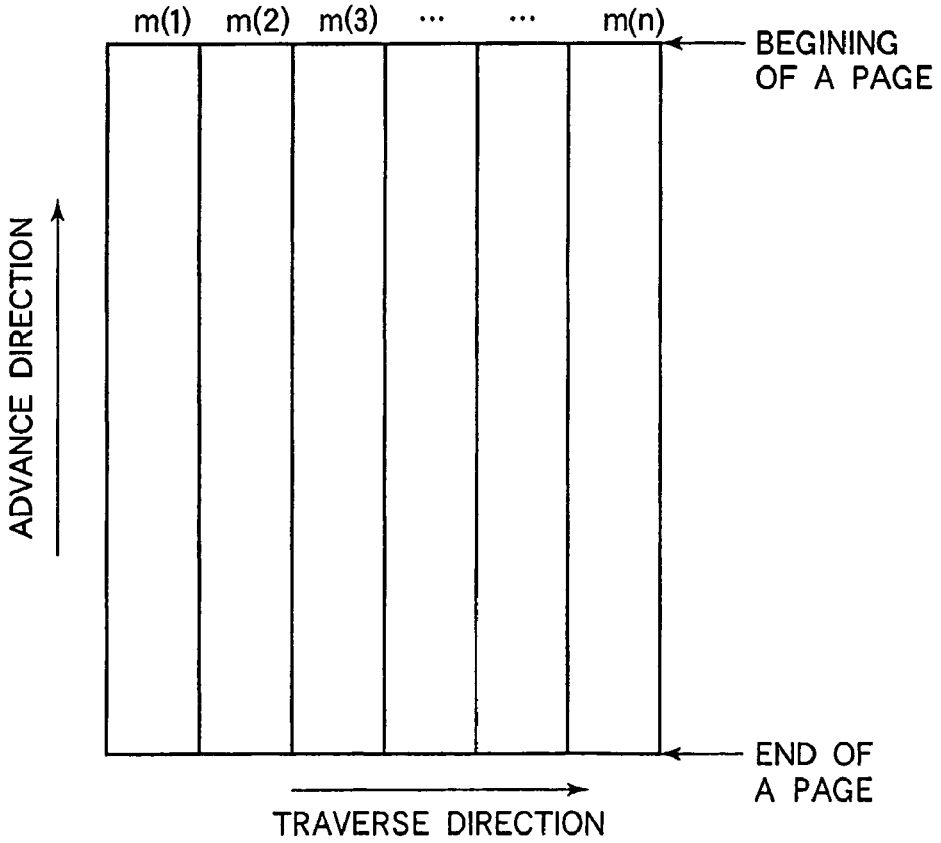
FIG. 5 illustrates a method for computing a dot population density.

FIG. 4 illustrates an example of printing of the first embodiment. FIG. 5 illustrates the method for computing a dot population density.

FIG. 4 shows a print pattern in the shape of a belt extending in an advance direction (direction of travel of print paper) perpendicular to a traverse direction. The area (defined by hatching) in which the belt-shaped print pattern is printed has a high dot population density while areas in which the belt-shaped print pattern is not printed have a low dot population density (e.g., 0%). The toner on the developing roller 17 in an area corresponding to the belt-shaped print pattern will be charged to a higher potential than the toner on the developing roller 17 in areas surrounding the belt-shaped print pattern, leading to spoiled images, soiling of print paper, and vague images.

In the present embodiment, the image data of a print job is printed in a printable area of a page of a print medium (paper, OHP, etc) as shown in FIG. 5. The printable area is divided into n sub printable areas (n is an integer), i.e., m(1), m(2), m(3), . . . , m(i), . . . , m(n), and therefore the image data is also divided into n sub data areas (n is an integer), i.e., m(1), m(2), m(3), . . . m(i), . . . , m(n) in correspondence with the sub printable areas. Because the image data corresponds to the printable area and a sub printable area(s) corresponds to a sub data area(s), the term sub printable area(s) and the term sub data area(s) are interchangeable in this specification.

Image data may occupy only a fraction of a printable area of a page of print medium, in which case the drum count A may be a fraction of a total number of rotations of the photoconductive drum 14 required for printing on one complete page. The image data area is divided into n sub data areas aligned in the traverse direction. Instead, the image data area may be divided into n sub data areas aligned in the advance direction. Further, the image data area may be divided even into a m×n matrix.

The dot counters Cm(1), Cm(2), Cm(3), . . . , Cm(i), . . . , Cm(n) count the number of printed dots in sub data areas m(1), m(2), m(3), . . . m(i), . . . , m(n), respectively, under the control of the controller 40.

The drum counter 49 counts the drum counts A under the control of the controller 40, and sends the drum counts A to the corresponding computing sections Cd(1), Cd(2), Cd(3), . . . , Cd(i), . . . , and Cd(n), respectively.

The computing sections Cd(1), Cd(2), Cd(3), Cd(i), . . . , Cd(n) read dot counts from the dot counters Cm(1), Cm(2), Cm(3), . . . Cm(i), . . . , . . . , Cm(n), respectively, under the control of the controller 40.

Each of the computing sections Cd(1) to Cd(n) computes a dot population density d(i) for a corresponding sub data area m(i) based on the dot count counted by a corresponding dot counter Cm (i), the drum count A, and a total printable dots per one complete rotation of the photoconductive drum 14 as follows:

$$\text{Dot population density } d(i) = \frac{Pm(i)}{C0 \times A} \qquad \text{Eq. 1}$$

where d(i) is the dot population density for i-th sub data area m(i), Pm(i) is the number of dots counted by the dot counter for the i-th sub data area m(i), C0 is a total number of printable dots per one complete rotation of the photoconductive drum, and A is the drum count.

The comparing section 44 reads the computed dot population densities d(1) to d(n) and the reference density Dref from the reference storing section 45. Then, the comparing section 44 compares each of the dot population densities d(1) to d(n) with the reference density Dref, and outputs a comparison result to the controller 40. In this manner, the controller 40 makes a decision to determine whether each of the computed dot population densities d(1) to d(n) is higher than the reference density Dref.

In the present embodiment, the drum count A is used in computing the dot population density. The number of rotations of the developing roller 17, the number of rotations of the toner supplying roller 17*a*, or the number of rotations of the transfer roller 18 may also be used in place of the drum count A.

{Discarding Deteriorated Toner}

A description will be given of a case in which the toner is discarded if the dot population density continues to be low for a time period longer than a predetermined value.

Figure 6:
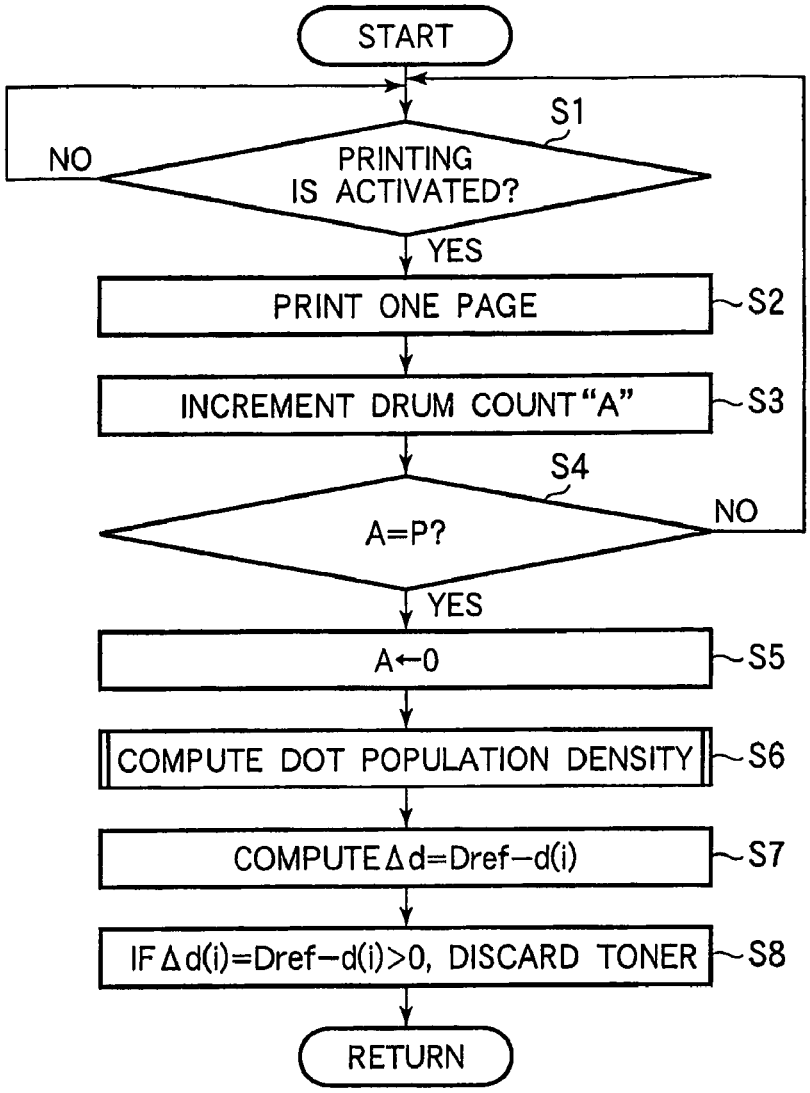
FIG. 6 is a flowchart illustrating the operation of the printer.
Figure 7:
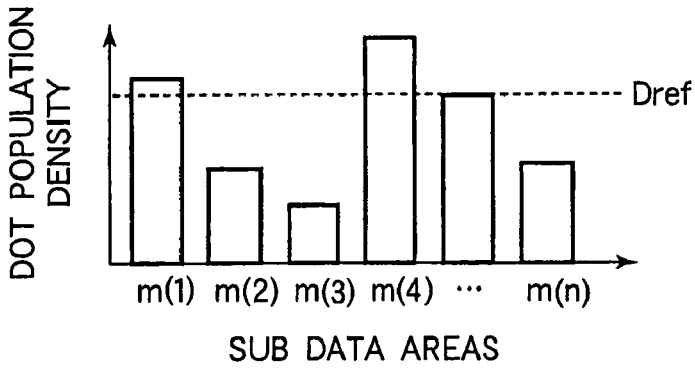
FIG. 7 illustrates the amount of toner discarded for each of the sub data areas.

FIG. 6 is a flowchart illustrating the operation of the printer. FIG. 7 illustrates the amount of toner discarded for each of the sub data areas m(1), m(2), m(3), . . . , m(i), . . . , m(n).

When a printing operation is commanded by the controller 40, the print controller 41 starts to print on one page of print paper, and the drum counter 49 increments the drum count A as the photoconductive drum 14 rotates.

A drum count monitor 40*a* of the controller 40 checks the drum count A to determine whether the drum count A has reached the threshold value P. Alternatively, a cumulative amount of time required for printing image data of low dot population density may be monitored, in which case, when the cumulative amount of time has reached a predetermined value, for example, one hour, deteriorated toner particles should be discarded.

The drum count A indicates a cumulative number of rotations of the photoconductive drum during printing, and is incremented every time the photoconductive drum rotates. The threshold value P is the value of drum count A required for printing 50 pages of print paper. Thus, the threshold value P may vary depending on the size of print paper. For example, when printing is performed on A4 size print paper, P is 50×3 (=150) where the value "3" is the required number of rotations of the photoconductive drum 14 for printing on one page of A4 size paper.

When the drum count A reaches 150, the drum count monitor 40*a* clears the drum count A.

The computing sections Cd(1) to Cd(n) compute the dot population densities d(1), d(2), d(3), . . . , d(i), . . . , d(n) based on the dot counts in the sub data areas m(1), m(2), m(3), . . . , m(i), . . . , m(n), respectively.

A subtracting section 44*a* in the comparing section 44 computes differences Δd(1), Δd(2), Δd(3), . . . , Δd(i), . . . , Δd(n) between the reference density Dref and the dot population densities d(1), d(2), . . . , d(i), . . . d(n), i.e., Δd(i)=Dref−d(i).

If any one of the differences Δd(1), Δd(2), Δd(3), . . . , Δd(i), . . . , Δd(n) is a positive value, then a decision section 40*b* decides to discard the toner on the developing roller 17 in an area corresponding to that difference Δd(i). Then, in response to the decision by the decision section 40*b*, the print controller 41 discards the toner on the developing roller 17 in an area corresponding to that difference Δd(i). If all of Δd(1), Δd(2), Δd(3), . . . , Δd(i), . . . , Δd(n) are a negative value, the decision section 40*b* does not decide to discard the toner in an area on the developing roller 17 corresponding to that difference Δd(i).

As described above, when any one of the dot population densities d(1), d(2), . . . , d(i), . . . , d(n) is lower than the reference density Dref, the decision section 40*b* decides that toner deposited on the developing roller 17 in an area where d(i) is lower than the reference density Dref should be discarded.

When the drum count A reaches the threshold value P, the computing sections Cd(1) to Cd(n) compute the dot population densities d(1), d(2), d(3), . . . , d(i), . . . , d(n) for the sub data areas m(1), m(2), m(3), . . . , m(i), . . . , m(n). If the dot population density in a sub data area m(i) is not larger than Dref, the toner on the developing roller 17 in an area corresponding to the sub data area is not discarded. Referring to FIG. 7, the dot population densities d(2), d(3), and d(n) for sub data areas m(2), m(3), and m(n) are not larger than Dref. A print pattern having a number of dots equal to the number of dots required for the dot population densities d(2), d(3), and d(n) to be equal to the Dref is printed, thereby discarding the toner on the developing roller 17 in areas corresponding to the sub data areas m(2), m(3), and m(n). If the dot population density in a sub data area is lower than Dref (i.e., dot population densities in the sub data areas m(2), m(3) and m(n)), then the toner on the developing roller 17 in an area corresponding to the sub data area should be discarded.

The toner discarding section 40*c* provides a command to discard the toner to the print controller 41. The print controller 41 generates a toner discarding print pattern for each of the sub data areas m(1), m(2), m(3), . . . , m(i), . . . , m(n) in which the dot population density is too low. The print controller 41 prints the toner discarding print pattern so that the deteriorated toner on the developing roller 17 in an area corresponding to the low dot population density is transferred to the photoconductive drum 14 and is then transferred onto the print paper. In this manner, the toner may be discarded from the developing roller 17 by forcibly consuming the deteriorated toner.

The toner discarding print pattern is a pattern having a dot population density of 100%. The length of the toner discarding print pattern in the advance direction is selected such that the dot population densities d(1), d(2), . . . , d(i), . . . , d(n) are equal to Dref. The toner discarding operation may be performed before, after, or during a printing operation.

As described above, when a limited portion of the printable area or of the image data area is printed at a low dot population density, if, for example, an average dot population density in the printable area or in the image data area is relatively high, the deteriorated toner on the developing roller 47 corresponding to the limited portion of the printable area may be discarded.

As described above, the toner on the photoconductive drum 14 may be removed before the toner is seriously deteriorated due to local overcharging and/or excessive friction, so that spoiled images, soiling of print paper, and vague images may be prevented. Thus, image quality may be maintained even when an images having a low dot population density is printed.

The flowchart shown in FIG. 6 will be described.

Step S1: The program waits for activation of a printing operation. When a printing operation is activated, the program proceeds to step S2.

Step S2: Printing is performed on one page.

Step S3: The drum counter 49 increments the drum count A.

Step S4: A check is made to determine whether the drum count A is equal to the threshold value P. If the drum count A is equal to the threshold value P, then the program proceeds to step S5. If the drum count A is not equal to the threshold value P, then the program loops back to step S1.

Step S5: The drum count A is reset.

Step S6: The computing sections Cd(1) to Cd(n) compute the dot population densities d(1), d(2), . . . , d(i), . . . , d(n).

Step S7: The subtracting section 44*a* computes the differences Δd(1), Δd(2), Δd(3), . . . , Δd(i), . . . , Δd(n) where Δd(i)=Dref−d(i).

Step S8: The toner on the developing roller 17 in an area corresponding to a positive value of the difference is discarded.

Second Embodiment

Elements similar to those of the first embodiment have been given the same reference numerals and their description is omitted. The same structures as the first embodiment provide the same performance and advantages.

Figure 8:
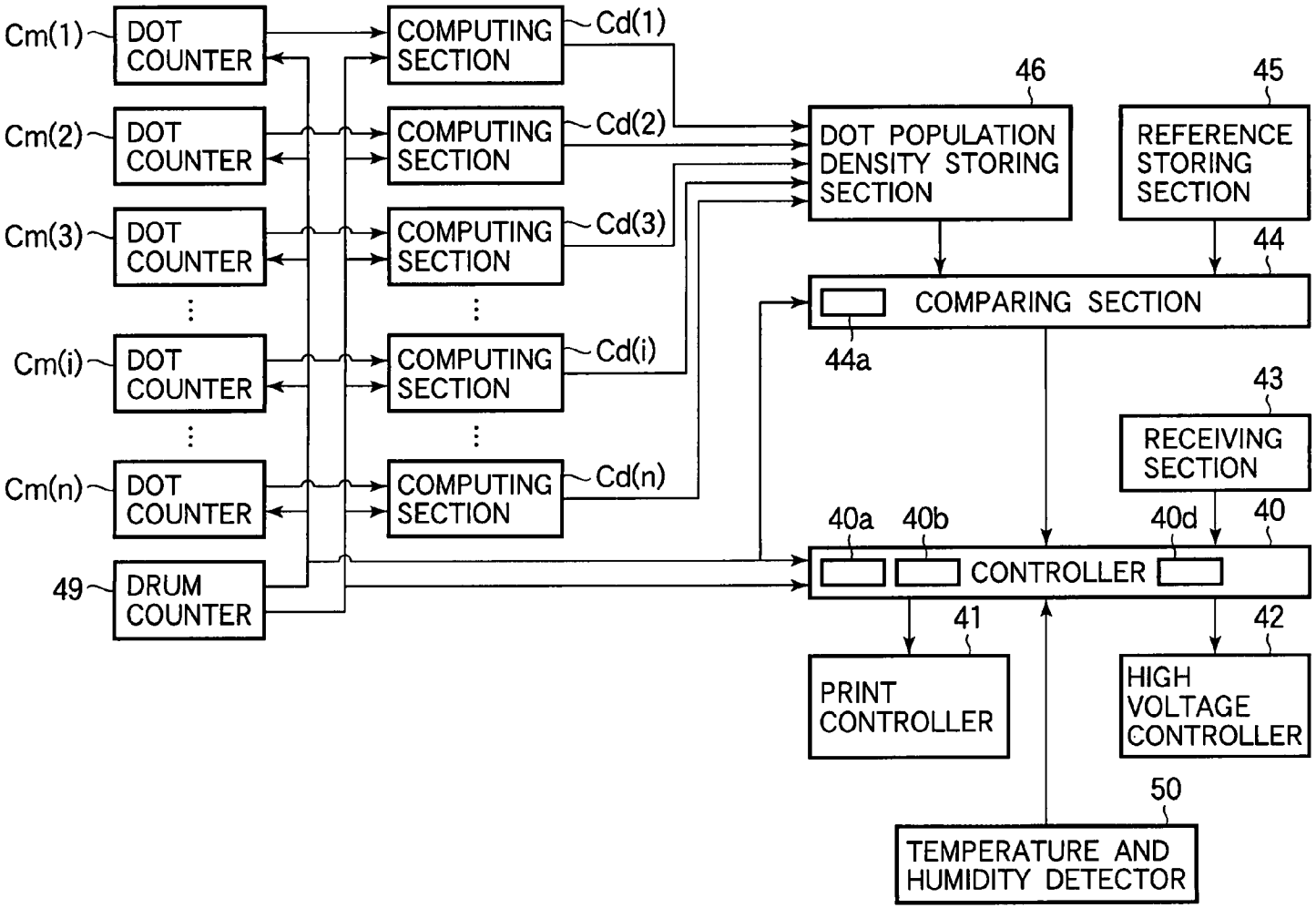
FIG. 8 is a block diagram illustrating the configuration of a controller for the printer of a second embodiment.

FIG. 8 is a block diagram illustrating the configuration of a controller for a printer of a second embodiment.

A temperature and humidity detector 50 detects the environmental conditions (i.e., temperature and humidity) inside of the printer, and sends the detection signals to a controller 40.

The operation of the printer having the aforementioned configuration will be described.

Figure 9:
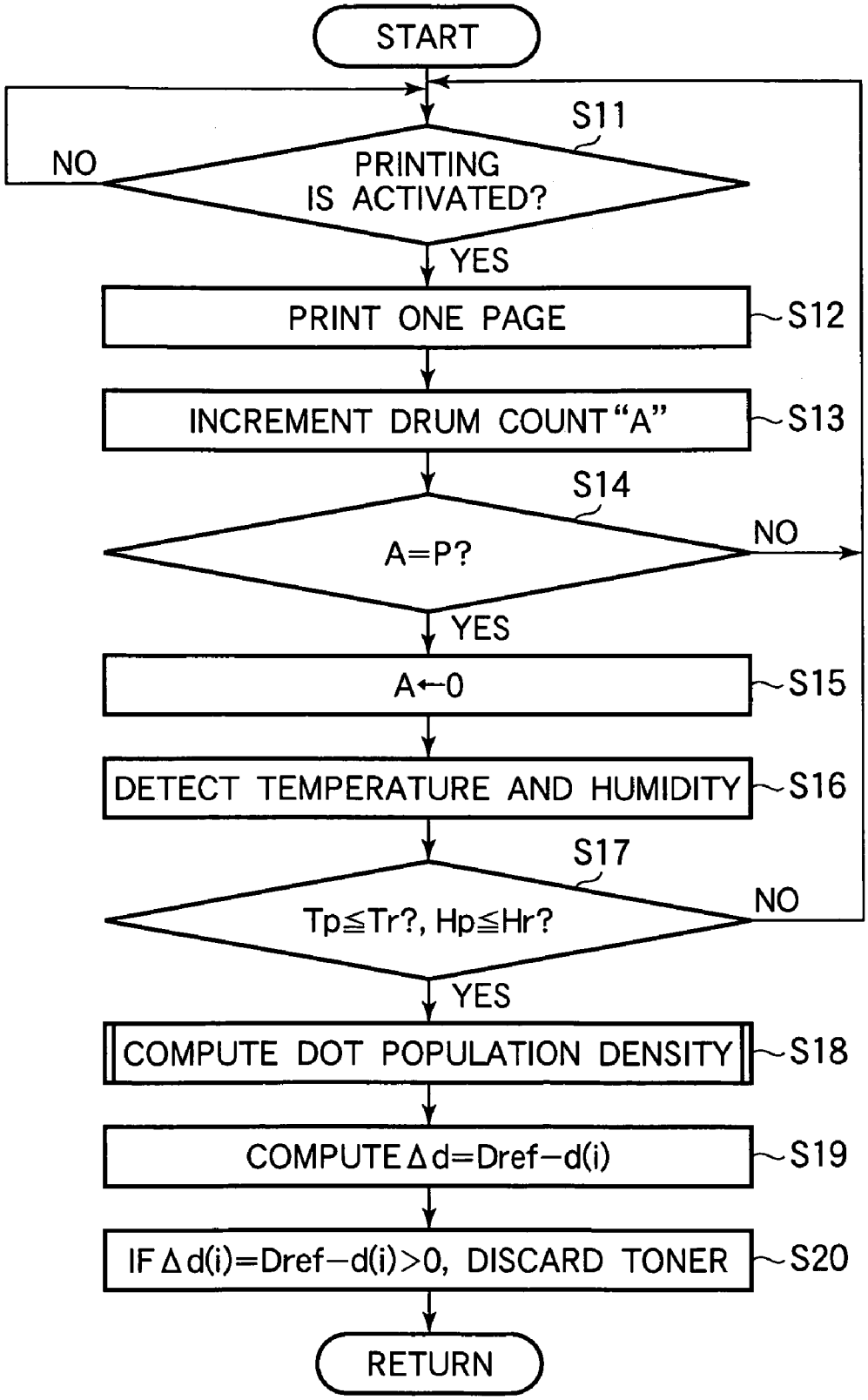
FIG. 9 is a flowchart illustrating the operation of the printer of the second embodiment.

FIG. 9 is a flowchart illustrating the operation of the printer.

When a printing operation is activated, a print controller 41 performs printing on one page of print paper. A drum counter 49 (FIG. 8) increments a drum count A every time the photoconductive drum makes one complete rotation.

Subsequently, a drum count monitor 40*a* makes a decision to determine whether the drum count A has reached a threshold value P. If the drum count A has reached the threshold value P, the drum count monitor 40*a* clears the drum count A.

An environment detecting section 40*d* makes a decision to determine whether a detected temperature Tp and a detected humidity Hp are not higher than a reference temperature Tr and a reference humidity Hr, respectively. Generally speaking, the potential of the toner on the developing roller 17 tends to be higher in a low-temperature and low-humidity environment.

If the detected temperature Tp is not higher than the reference temperature Tr and the detected humidity Hp is not higher than the reference humidity Hr, the dot population densities are computed just as in the first embodiment. If the detected temperature Tp is higher than the reference temperature Tr and the detected humidity Hp is higher than the reference humidity setting Hr, the dot population densities are not computed.

Computing sections Cd(1), Cd(2), Cd(3), . . . , Cd(i), . . . , Cd(n) compute dot population densities d(1), d(2), . . . , d(i), . . . d(n) for sub data areas m(1), m(2), . . . , m(i), . . . , m(n), respectively. A subtracting section 44*a* in the comparing section 44 computes differences Δd(1), Δd(2), Δd(3), . . . , Δd(i), . . . , Δd(n) between the reference density Dref and the dot population densities d(1), d(2), . . . , d(i), . . . d(n), i.e., Δd(i)=Dref−d(i). A decision section 40*b* makes a decision to determine whether the toner on the developing roller 17 in an area corresponding to a sub data area should be discarded. If a dot population density d(i) is smaller than the reference density Dref, the toner on the developing roller 17 in an area corresponding to the population density d(i) smaller than the reference density Dref is discarded.

As described above, the toner on the developing roller 17 is discarded only when the detected temperature Tp and detected humidity Hp in the printer are lower than the reference temperature Tr and reference humidity Hr, respectively. In this manner, a minimum amount of toner may be discarded.

The flowchart shown in FIG. 9 will be described.

Step S11: The program waits for activation of a printing operation. When a printing operation is activated, the program proceeds to step S12.

Step S12: Printing is performed on one page.

Step S13: The drum count A is incremented.

Step S14: A check is made to determine whether the drum count A is equal to the threshold value P. If the drum count A is equal to the threshold value P, then the program proceeds to step S15. If the drum count A is not equal to the threshold value P, then the program jumps back to step S11.

Step S15: The drum count A is reset.

Step S16: Temperature Tp and humidity Hp are detected.

Step S17: If the detected temperature Tp is not higher than the reference temperature Tr and the detected humidity Hp is not higher than the reference humidity Hr, the program proceeds to step S18. If the detected temperature Tp is higher than the reference temperature Tr and the detected humidity Hp is higher than the reference humidity Hr, the program loops back to S11.

Step S18: The computing sections Cd(1) to Cd(n) compute the dot population densities d(1), d(2), . . . , d(i), . . . , d(n).

Step S19: The subtracting section 44*a* computes the differences Δd(1), Δd(2), Δd(3), . . . , Δd(i), . . . , Δd(n) where Δd(i)=Dref−d(i).

Step S20: Toner on the developing roller in an area corresponding to a positive value of the difference is discarded.

Third Embodiment

Elements similar to those of the first embodiment have been given the same reference numerals and their description is omitted. The same structures as those of the first embodiment provide the same performance and advantages.

Figure 10:
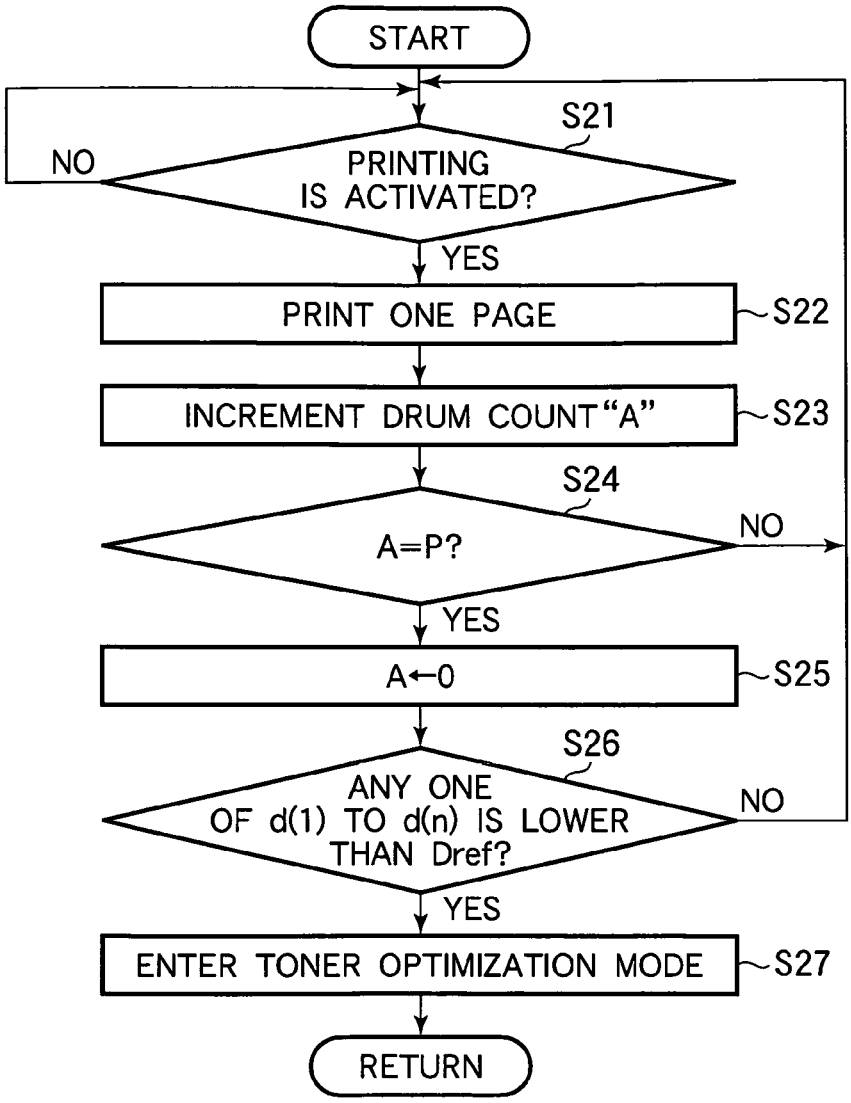
FIG. 10 is a flowchart illustrating the operation of the printer of a third embodiment.
Figure 11:
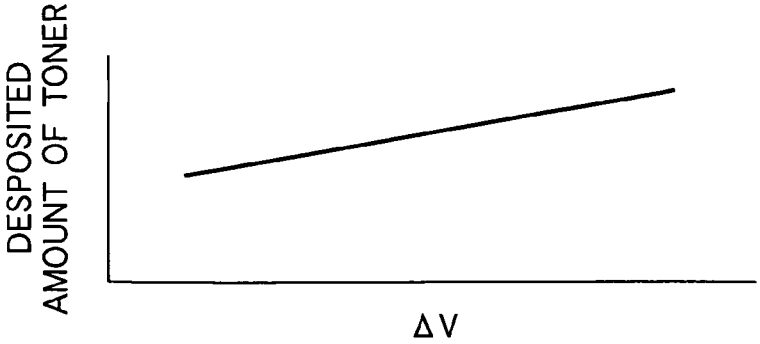
FIG. 11 illustrates the relation between the amount of toner deposited on a developing roller and the difference between the output voltage of a developing power supply and the output voltage of a toner supplying roller power supply.
Figure 12:
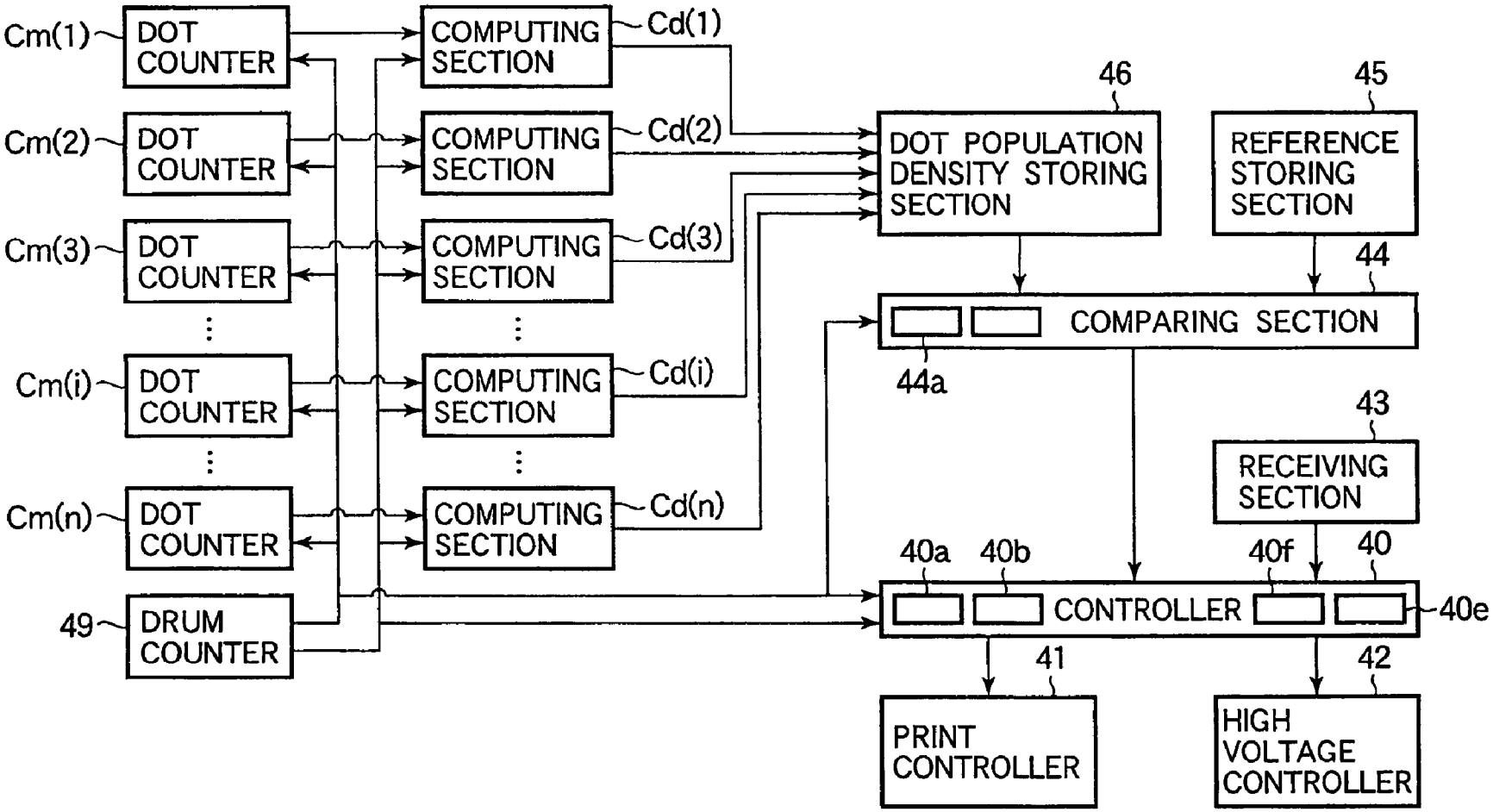
FIG. 12 is a block diagram illustrating the overall controller for the printer of the fourth embodiment.

FIG. 10 is a flowchart illustrating the operation of a printer of a third embodiment. FIG. 11 illustrates the relation between the amount of toner deposited on a developing roller 17 and the difference ΔV between the output voltage of a developing power supply 32 and the output voltage of a toner supplying roller power supply 33. FIG. 12 is a block diagram illustrating the overall controller for the printer of the third embodiment. It is to be noted that the amount of toner deposited on a developing roller 17 is proportional to the voltage difference ΔV.

Referring to FIG. 12, when a printing operation is activated, a print controller 41 performs printing on one page of print paper. A drum counter 49 (FIG. 8) increments a drum count A as the photoconductive drum 14 rotates.

Subsequently, a drum count monitor 40*a* makes a decision to determine whether the drum count A has reached a threshold value P. If the drum count A has reached a threshold value P, the drum count monitor 40*a* clears the drum count A.

Computing sections Cd(1), Cd(2), Cd(3), . . . , Cd(i), . . . , Cd(n) compute the dot population densities d(1), d(2) . . . , d(i), . . . d(n) for sub data areas m(1), m(2), . . . , m(i), . . . , m(n), respectively.

A comparing section 44 compares the dot population densities d(1), d(2) . . . , d(i), . . . d(n) with the reference density Dref. If at least one of the dot population densities d(1), d(2), . . . , d(i), . . . d(n) is lower than the reference density Dref, then an optimization mode section 40*e* activates a toner optimization mode. In this manner, the comparing section 44 makes a decision as to whether the toner on the developing roller 17 in an area corresponding to a dot population density lower than the reference density Dref should be discarded.

The toner optimization mode will be described.

The output voltage V1 of the developing power supply 32 and the output voltage V2 of the toner supplying power supply 33 are related such that $|V1| \leqq |V2|$ and V1 and V2 are of the same polarity.

The voltage difference ΔV=V2−V1 and the amount of toner deposited on the developing roller 17 are related as shown in FIG. 11. Referring to FIG. 11, the amount of toner deposited on the developing roller 17 decreases with decreasing value of the voltage difference ΔV.

A single-component toner of the third embodiment is charged negatively and the amount of toner deposited to the developing roller 17 depends on the electric field developed across the developing roller 17 and the toner supplying roller 17*a*.

The voltages V1 and V2 are controlled to change depending on the environmental conditions, dot population densities, and the operating statuses of the image forming sections 15Y, 15M, 15C, and 15BK. However, the amount of toner deposited on the developing roller 17 may be excessive even when voltages V1 and V2 are optimum (during printing, V1=150 V and V2=220 V) since the charge on the toner particles and the flowability of the toner varies due to, for example, the environmental conditions and dot population densities. Excessive toner deposited on the developing roller 17 spoils printed images.

When the amount of toner deposited on the developing roller 17 is not excessive, if the photoconductive drum 14 continues to rotate for printing on the print paper at a low dot population density, the toner on the developing roller 17 is overcharged, possibly spoiling the print images.

When the toner optimization mode is entered, a toner optimization section 40*f* makes a decision to determine whether the number of printed pages exceeds a predetermined value.

When printing is not being performed, if the voltages V1 and V2 are of the same polarity and the absolute value of V1 is smaller than that of the voltage V2, then the absolute value of the difference voltage ΔV is larger when printing is not being performed than when printing is being performed.

When printing is not being performed, if the absolute value of V1 is equal to that of the voltage V2, then the absolute value of the difference voltage ΔV is zero volts.

When printing is not being performed, if the voltages V1 and V2 are of the same polarity and the absolute value of V1 is larger than that of the voltage V2, then the absolute value of the difference voltage ΔV may be larger or smaller when printing is not being performed than when printing is being performed.

When printing is not being performed, if the voltages V1 and V2 are of the opposite polarities, then the absolute value of the difference voltage ΔV may be larger or smaller when printing is not being performed than when printing is being performed.

If the number of printed pages is larger than the predetermined value, the toner optimization section 40*f* changes the voltages V1 and V2 such that the absolute value of the difference voltage ΔV is smaller when an image is not being printed than when an image is being printed. The absolute value of the difference voltage ΔV may be a positive value, zero, or a negative value, depending on the amount of toner that should be returned from the developing roller 17 to the toner supplying roller 17*a*. Generally, the absolute value of the voltage difference ΔV may be set at least 50 V higher when printing is not being performed than when printing is being performed. As described above, the excessive toner on the developing roller 17 may be returned to the toner supplying roller 17*a* by decreasing, increasing, or maintaining the absolute value of the voltage difference ΔV, depending on the amount of toner that should be returned from the developing roller 17 to the toner supplying roller 17*a*. In this manner, an increase of the amount of toner deposited on the developing roller 17 may be minimized by decreasing or shutting off the supply of the toner from the toner supplying roller 17*a* to the developing roller 17. The printer remains in the toner optimization mode for a predetermined time, for example, the time required for the developing roller to make one complete rotation.

For example, if the voltage V1 is −150 V, V2 is −220 V, and the voltage difference ΔV is −70 V during printing, then the voltage V2 is changed to, for example, −170 V, −150 V, or −100 V in the toner optimization mode, so that the absolute value of voltage difference |ΔV| is much lower than 70V.

The absolute value of the voltage difference ΔV is usually set smaller in the toner optimization mode than in the printing mode, the amount of charge of the toner deposited on the developing roller 17 may be made smaller. Also, setting the voltages V1 and V2 such that the voltage difference ΔV (=V2−V1) is zero (0) or a positive value allows the excessive toner (i.e., not deteriorated yet) on the developing roller 17 to be returned to the toner supplying roller 17*a*. In other words, in the toner optimization mode, the positive voltage difference ΔV causes the toner on the developing roller 17 to migrate to the toner supplying roller 17*a*.

The toner optimization mode is entered after a printing operation or between adjacent pages to be printed during continuous printing. During the toner optimization mode, the toner is returned from the developing roller 17 to the toner supplying roller 17*a*.

As described above, the printable area is divided into a plurality of sub data areas m(1)-m(n), and the dot population densities d(1)-d(n) are computed for the sub data areas m(1)-m(n). The voltages V1 and V2 are then changed based on the dot population density d(1)-d(n). Thus, when the image data has a relatively high average value of the dot population density but some sub data areas have a low dot population density, the amount of toner deposited on the developing roller 17 is reliably prevented from increasing.

The flowchart shown in FIG. 10 will be described.

Step S21: The program waits for activation of a printing operation. When a printing operation is activated, the program proceeds to step S22.

Step S22: Printing is performed on one page.

Step S13: The drum count A is incremented.

Step S24: A check is made to determine whether the drum count A is equal to the threshold value P. If the drum count A is equal to the threshold value P, then the program proceeds to step S25. If the drum count A is not equal to the threshold value P, then the program jumps back to step S21.

Step S25: The drum count A is reset.

Step S26: A check is made to determine whether any one of the dot population densities d(1)-d(n) is lower than the reference density Dref. If any one of the dot population densities d(1)-d(n) is lower than the reference density Dref, then the program proceeds to step S27. If all of the dot population densities d(1)-d(n) are equal to or larger than the reference density Dref, then the program proceeds to step S21.

Step S27: A toner optimization mode is entered.

Fourth Embodiment

Elements similar to those of the first embodiment have been given the same reference numerals and their description is omitted. The same structures as those of the first embodiment provide the same performance and advantages.

Figure 13:
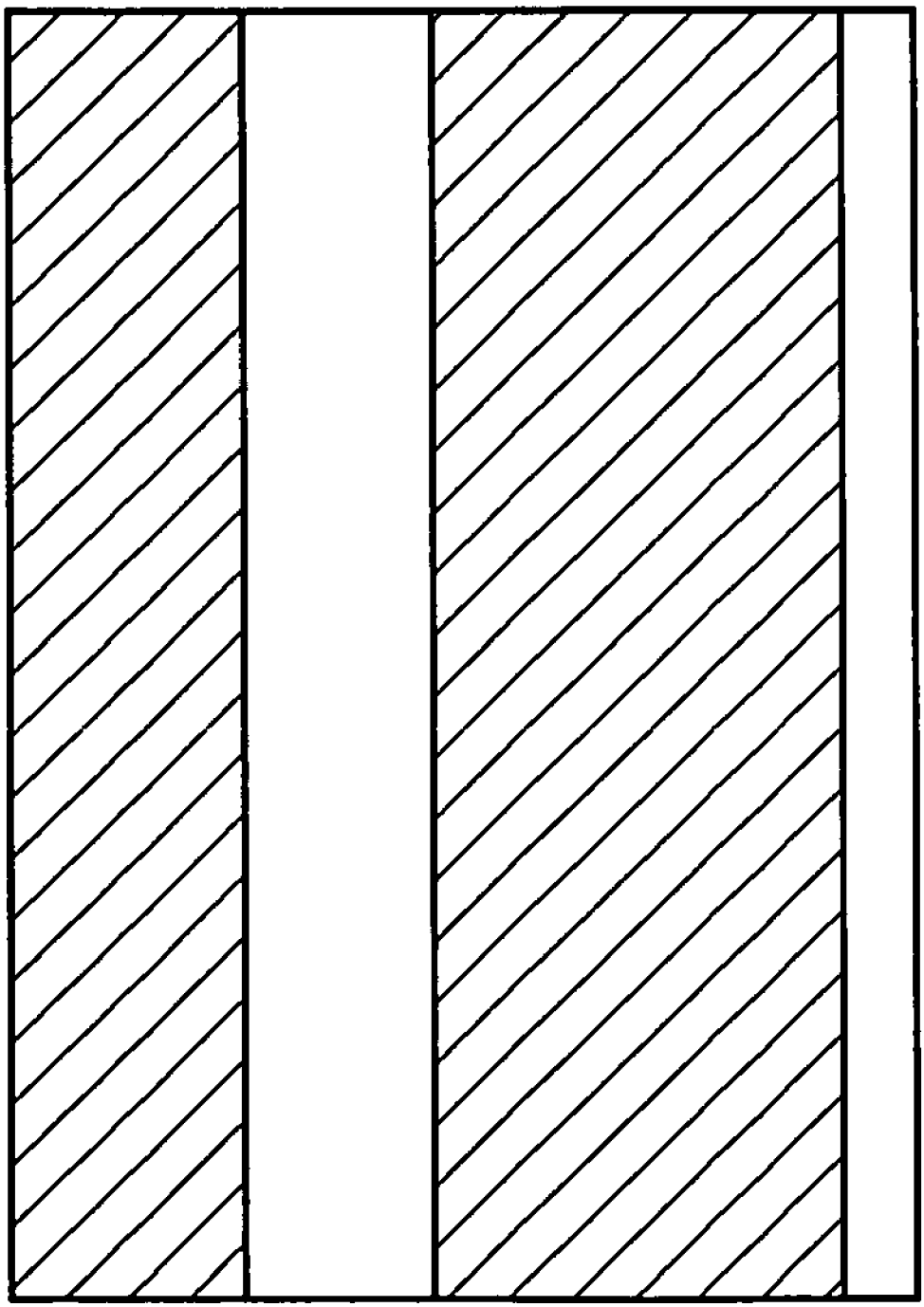
FIG. 13 illustrates a print pattern of a fourth embodiment.

FIG. 13 illustrates a print pattern of a fourth embodiment.

In the third embodiment, when a belt-shaped pattern extends in the advance direction as shown in FIG. 4 and continuous printing of the belt-shaped pattern is performed, if the dot population density d(i) of a sub data area m(i) is lower than Dref, the optimization mode is entered.

A print pattern shown in FIG. 13 has areas of a high dot population density occupy some percentage of the printable area and areas of a low dot population density occupy some percentage. On problem with the third embodiment is that when a print pattern such as that shown in FIG. 13 is printed, the optimization mode is entered.

Figure 14:
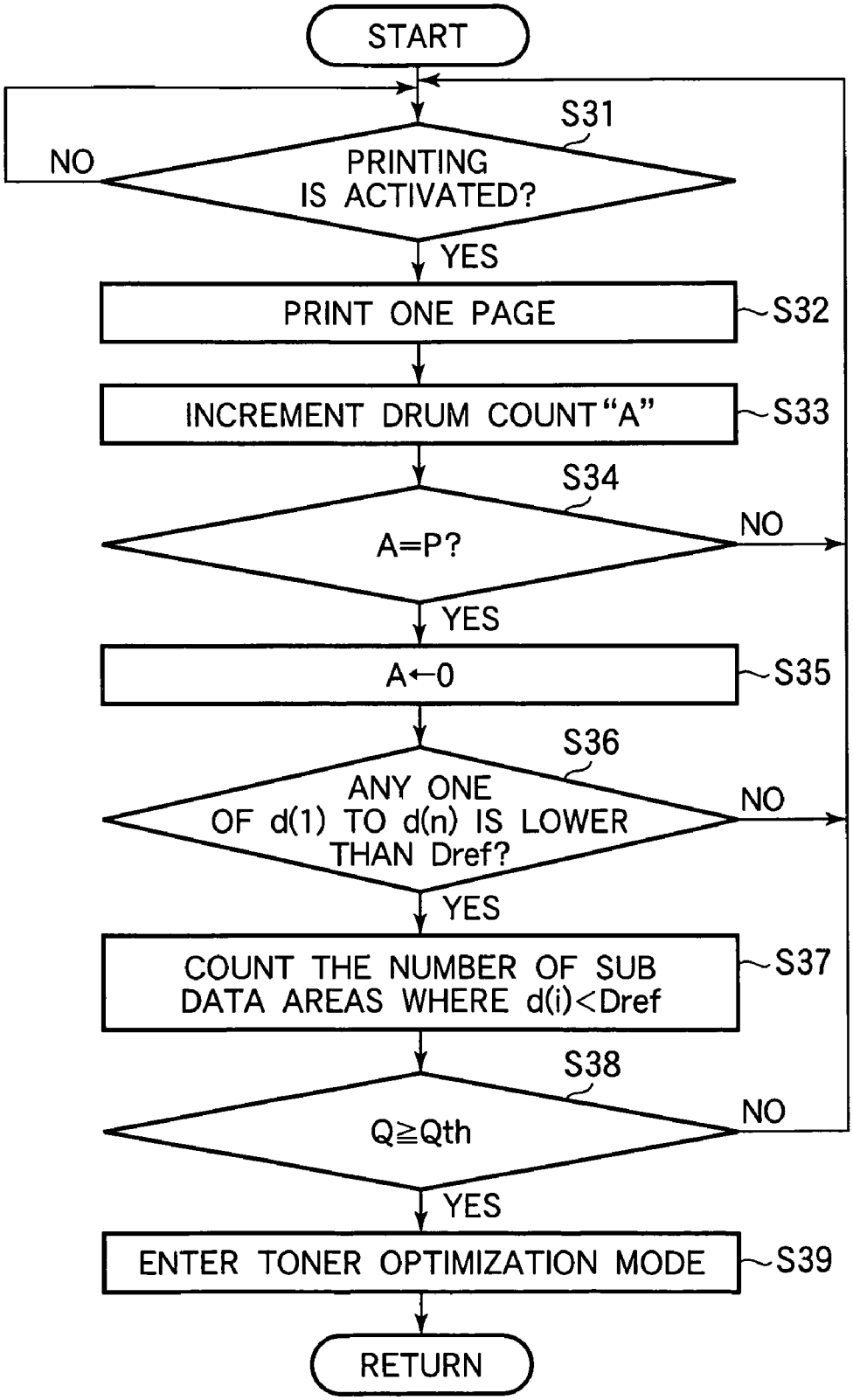
FIG. 14 is a flowchart illustrating the operation of the printer of the fourth embodiment.

The operation of a printer of the aforementioned configuration will be described. FIG. 14 is a flowchart illustrating the operation of the printer of the fourth embodiment.

Figure 15:
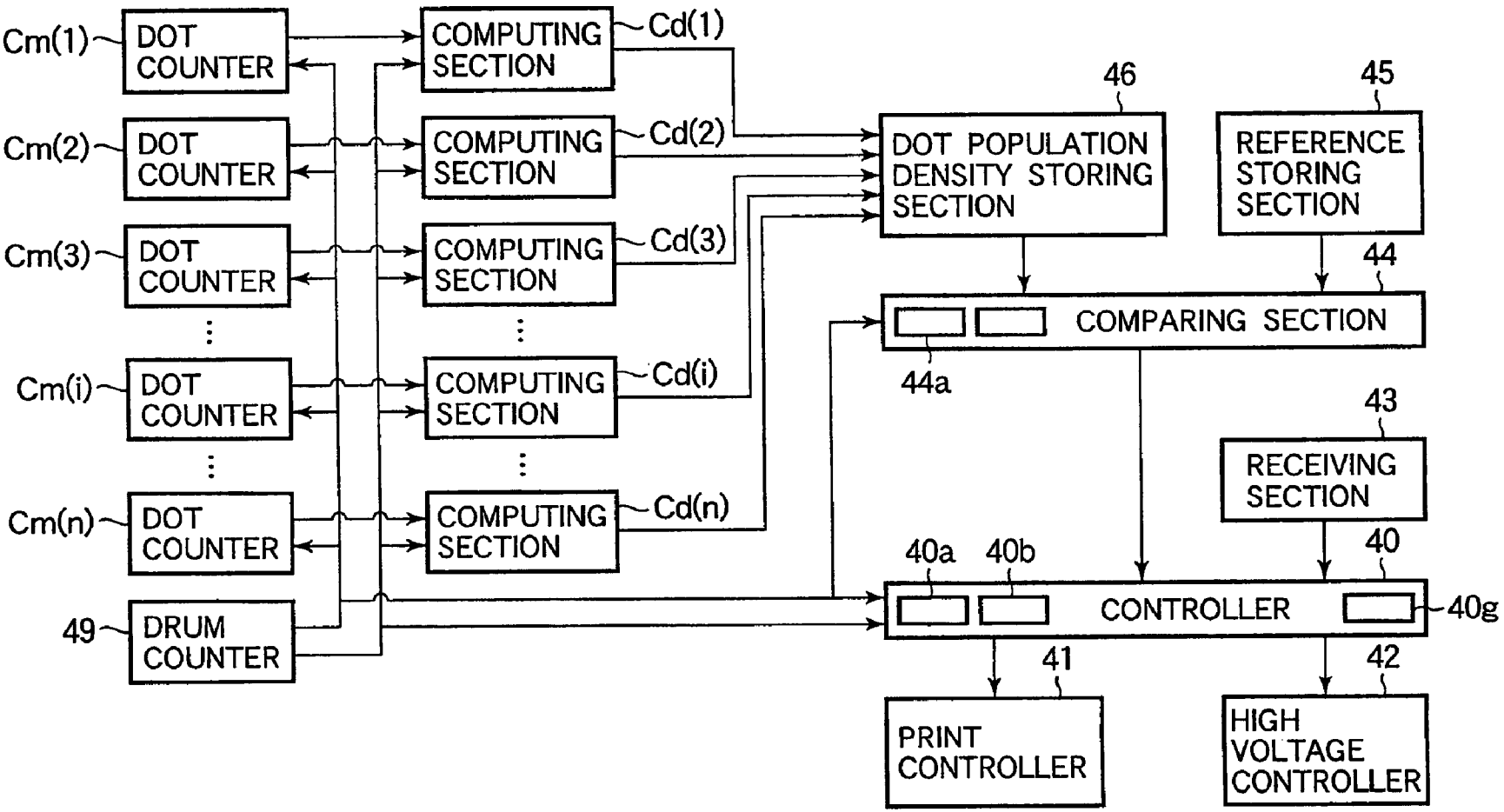
FIG. 15 is a block diagram illustrating the overall controller for the printer of the fourth embodiment.

FIG. 15 is a block diagram illustrating the overall controller for the printer of the fourth embodiment. When a printing operation is activated, a print controller 41 performs printing on one page of print paper. A drum counter 49 (FIG. 3) increments a drum count A as the photoconductive drum 14 rotates.

Subsequently, a drum count monitor 40*a* makes a decision to determine whether the drum count A has reached a threshold value P. If the drum count A has reached a threshold value P, the drum count monitor 40*a* clears the drum count A.

Computing sections Cd(1), Cd(2), Cd(3), . . . , Cd(i), . . . , Cd(n) compute the dot population densities d(1), d(2), . . . , d(i), . . . d(n) for sub data areas m(1), m(2), . . . , m(i), . . . , m(n), respectively.

The comparing section 44 makes a decision to determine whether the dot population densities d(1)-d(n) are lower than the reference density Dref, thereby counting the number of sub data areas Q in which the dot population density is lower than the reference density Dref.

Subsequently, a decision section 40*g* of a controller 40 makes a decision to determine whether the number of sub data areas Q is not smaller than a threshold value Qth. Since the threshold value Qth never exceeds the maximum number of sub data areas n, the following relation exists.

$$Qth \leqq n$$

In the fourth embodiment, the threshold value Qth is selected to be n/2. The comparing section 44 and the decision section 40*g* cooperate with each other to determine whether the toner on the developing roller 17 should be discarded.

If Q>Qth, the toner optimization mode is entered.

As described above, if Q>Qth, it is an indication that the dot population density is generally high over the entire printable area. Thus, the toner optimization mode is not entered more frequently than necessary.

The flowchart in FIG. 14 will be described.

Step S31: The program waits for activation of a printing operation. When a printing operation is activated, the program proceeds to step S32.

Step S32: Printing is performed on one page.

Step S33: The drum count A is incremented.

Step S34: A check is made to determine whether the drum count A is equal to the threshold value P. If the drum count A is equal to the threshold value P, then the program proceeds to step S35. If the drum count A is not equal to the threshold value P, then the program jumps back to step S31.

Step S35: The drum count A is reset.

Step S36: A check is made to determine whether any one of the dot population densities d(1)-d(n) is lower than the reference density Dref. If any one of the dot population densities d(1)-d(n) is lower than the reference density Dref, then the program proceeds to step S37. If all of the numbers of printed dots per unit area d(1)-d(n) are equal to or larger than the reference density Dref, then the program proceeds to step S31.

Step S37: The comparing section 44 counts the number of sub data areas Q in which the dot population density d(i) is lower than the reference density Dref.

Step S38: A check is made to determine whether the number of sub data areas Q is not smaller than the threshold value Qth. If Q≧Qth, the program proceeds to step S39. If Q<Qth, the program jumps back to step S31.

Step S39: The toner optimization mode is entered.

Fifth Embodiment

Elements similar to those of the first, second, and third embodiments have been given the same reference numerals and their description is omitted. The same structures as those of the first embodiment provide the same performance and advantages.

Figure 16:
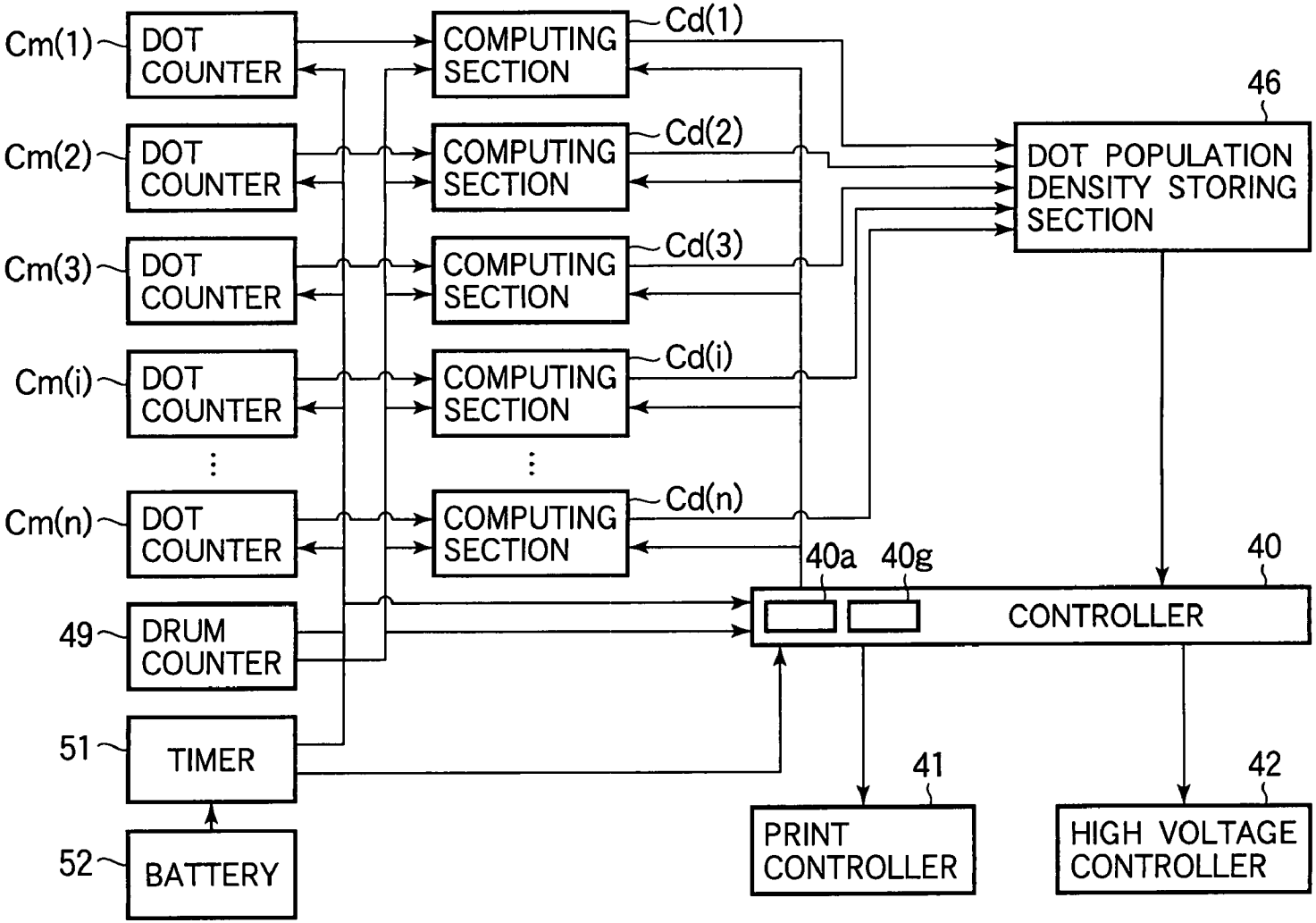
FIG. 16 is a block diagram illustrating the controller of the printer of a fifth embodiment.

FIG. 16 is a block diagram illustrating the controller of a printer of a fifth embodiment.

A timer 51 is powered by a battery 52 at all times and operates at all times. The timer 51 starts to count time upon the initial turn-on of the printer after the seal of the printer is broken, and then continues to operate even when the printer is turned off.

Figure 17:
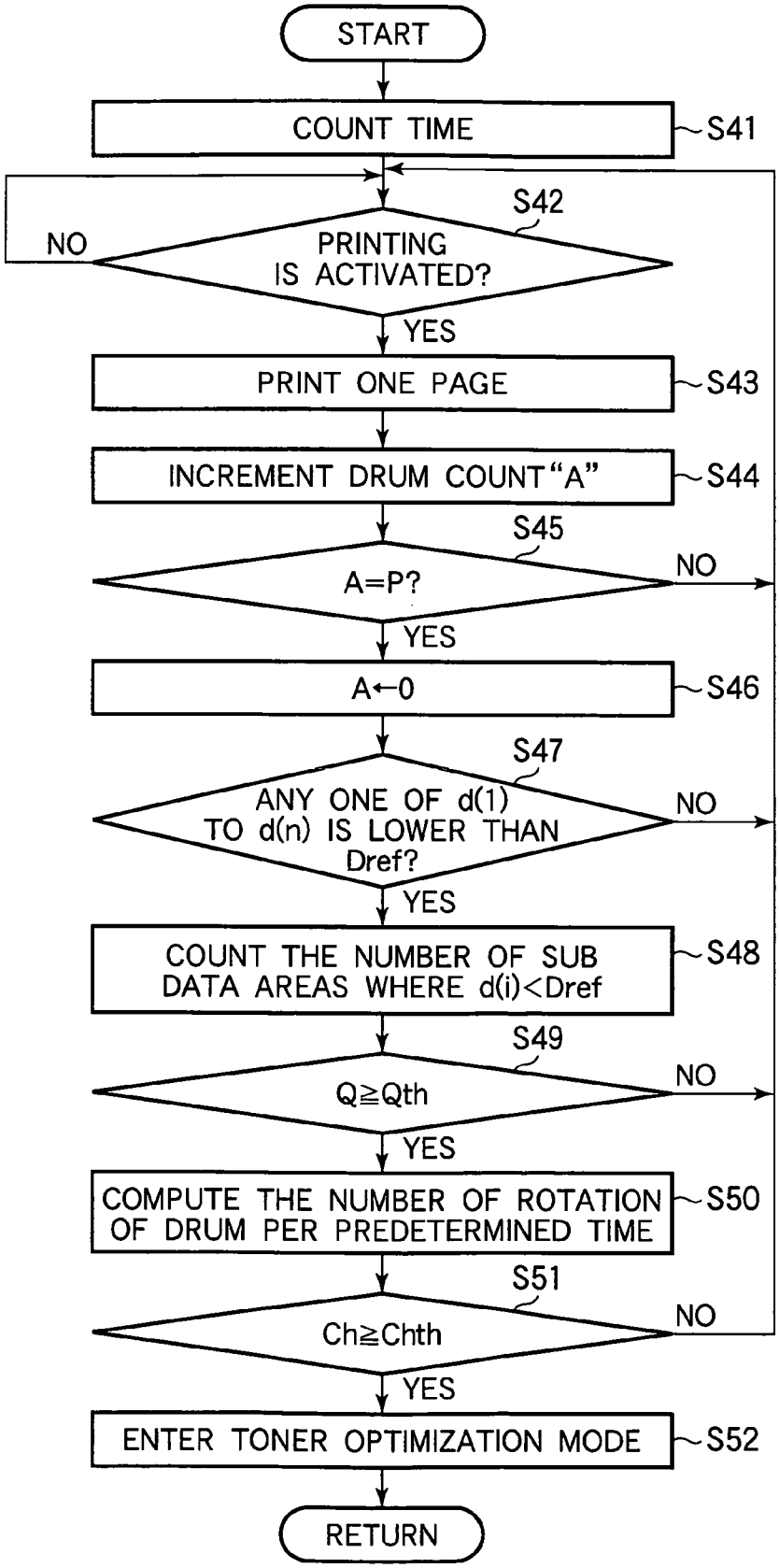
FIG. 17 is a flowchart illustrating the operation of the printer of FIG. 16.

The operation of the printer of the aforementioned configuration will be described. FIG. 17 is a flowchart illustrating the operation of the printer.

The timer 51 is counting time. When a printing operation is activated, a print controller 41 performs printing on one page of print paper. A drum counter 49 (FIG. 16) increments a drum count A as the photoconductive drum 14.

Subsequently, a drum count monitor 40*a* makes a decision to determine whether the drum count A has reached a threshold value P. If the drum count A has reached a threshold value P, the drum count monitor 40*a* clears the drum count A.

Computing sections Cd(1), Cd(2), Cd(3), . . . , Cd(i), . . . , Cd(n) compute the dot population densities d(1), d(2), . . . , d(i), . . . d(n) for sub data areas m(1), m(2), . . . , m(i), . . . , m(n), respectively. The computation is performed based on the dot counts for sub data areas m(1), m(2), . . . , m(i), . . . , m(n) and the total number of printable dots.

A comparing section 44 compares the dot population densities d(1), d(2), . . . , d(i), . . . d(n) with the reference density Dref, and counts the number of sub data areas Q in which the dot population density is lower than the reference density Dref.

Subsequently, a decision section 40*g* of a controller 40 makes a decision to determine whether the number of sub data areas Q is not smaller than a threshold value Qth. If Q≧Qth, then the drum count monitor 40*a* of the controller 40 reads the drum count A from the drum counter 49 and an elapsed time from the timer 51. Then, the drum count monitor 40*a* computes a drum count per a predetermined time, Ch, just before the printing operation was activated. The predetermined time is, for example, one hour.

The decision section 40*g* makes a decision to determine whether the drum count per the predetermined time, Ch is not smaller than a threshold value Chth. In the fifth embodiment, the threshold value Chth is selected to be 70% of a drum count (e.g., 4700 rotations) when continuous printing was performed through one hour. The comparing section 44 and the decision section 40*g* cooperate with each other to determine whether the toner on the developing roller 17 should be discarded, i.e., whether Q≧Qth.

If Ch≧Chth, it is an indication that printing operations are performed frequently. Therefore, it may be assumed that there is a chance of the potential of the toner deposited on the developing roller 17 increasing. Consequently, if Ch≧Chth, then the toner optimization mode is entered.

As described above, the toner optimization mode is entered only when printing is performed frequently, so that the toner optimization mode is not entered more frequently than necessary.

The flowchart in FIG. 17 will be described.

Step S41: The timer 51 counts time.

Step S42: The program waits for activation of a printing operation. When a printing operation is activated, the program proceeds to step S43.

Step S43: Printing is performed on one page of print paper.

Step S44: The drum count A is incremented.

Step S45: A check is made to determine whether the drum count A is equal to the threshold value P. If the drum count A is equal to the threshold value P, then the program proceeds to step S46. If the drum count A is not equal to the threshold value P, then the program jumps back to step S42.

Step S46: The drum count A is reset.

Step S47: A check is made to determine whether any one of the dot population densities d(1)-d(n) is lower than the reference density Dref. If anyone of the dot population densities d(1)-d(n) is lower than the reference density Dref, then the program proceeds to step S48. If all of the dot population densities d(1)-d(n) are equal to or larger than the reference density Dref, then the program proceeds to step S42.

Step S48: The comparing section 44 counts the number of sub data areas, Q, in which the dot population density is lower than the reference density Dref.

Step S49: The decision section 40*g* makes a decision to determine whether the number of sub data areas, Q is not smaller than the threshold value Qth. If Q≧Qth, the program proceeds to step S50. If Q<Qth, then the program jumps back to step S42.

Step S50: The drum count monitor 40*a* computes a drum count per the predetermined time, Ch, just before the printing operation was activated.

Step S51: The decision section 40*g* makes a decision to determine whether the drum count per the predetermined time, Ch is not smaller than a threshold value Chth. If Ch≧Chth, then the program process to step S52. If Ch≧Chth, then the program loops back to steps S42.

Step S52: The decision section 40*g* mode is entered.

Sixth Embodiment

Elements similar to those of the fifth embodiment have been given the same reference numerals and their description is omitted. The same structures as those of the first embodiment provide the same performance and advantages.

Figure 18:
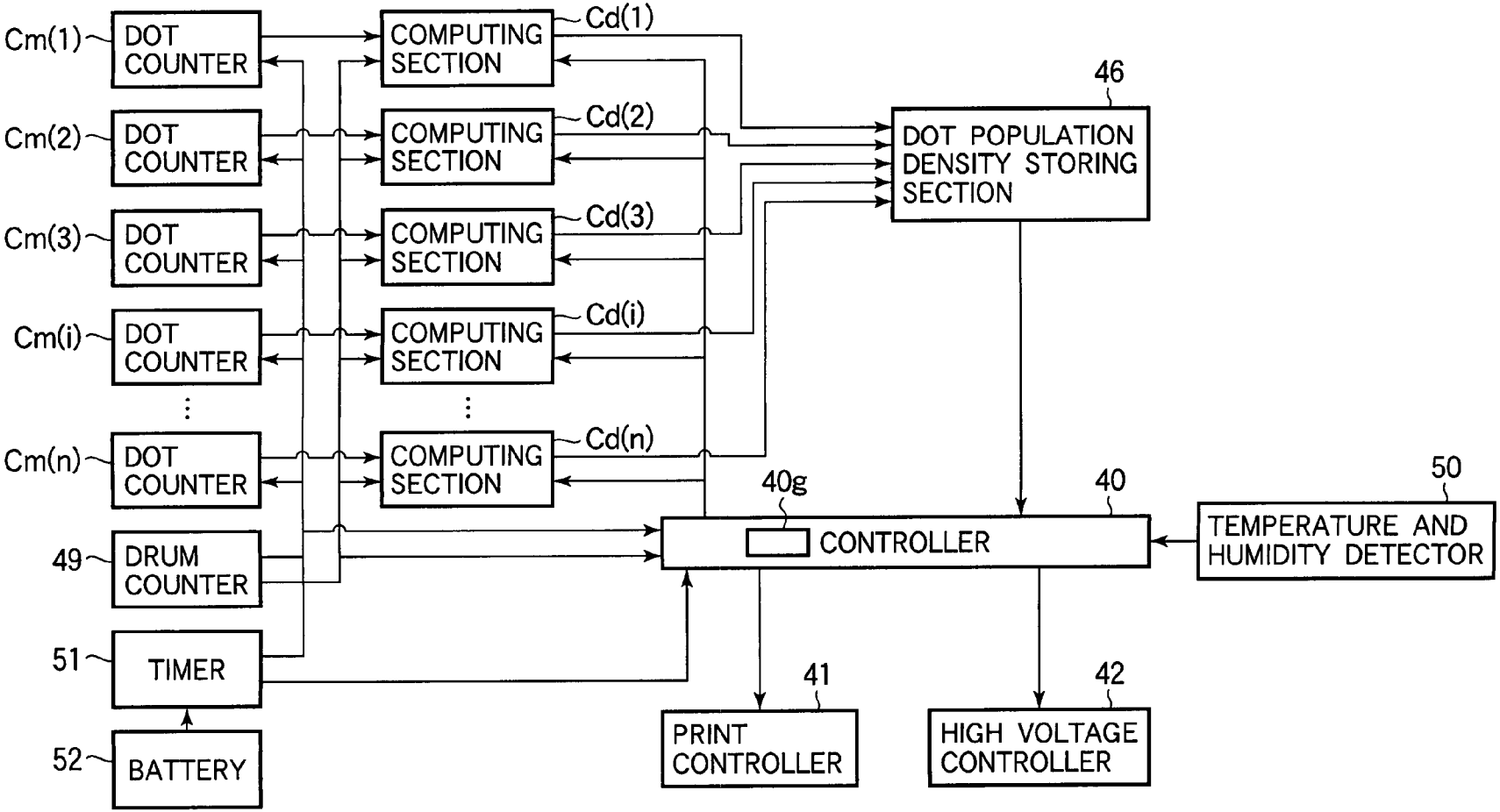
FIG. 18 is a block diagram illustrating the printer of a sixth embodiment.

FIG. 18 is a block diagram illustrating a printer of a sixth embodiment.

A temperature and humidity detecting section 50 detects the temperature Tp and humidity Hp inside of the printer and provides detection signals to a controller 40.

The operation of the printer of the aforementioned configuration will be described.

Figure 19:
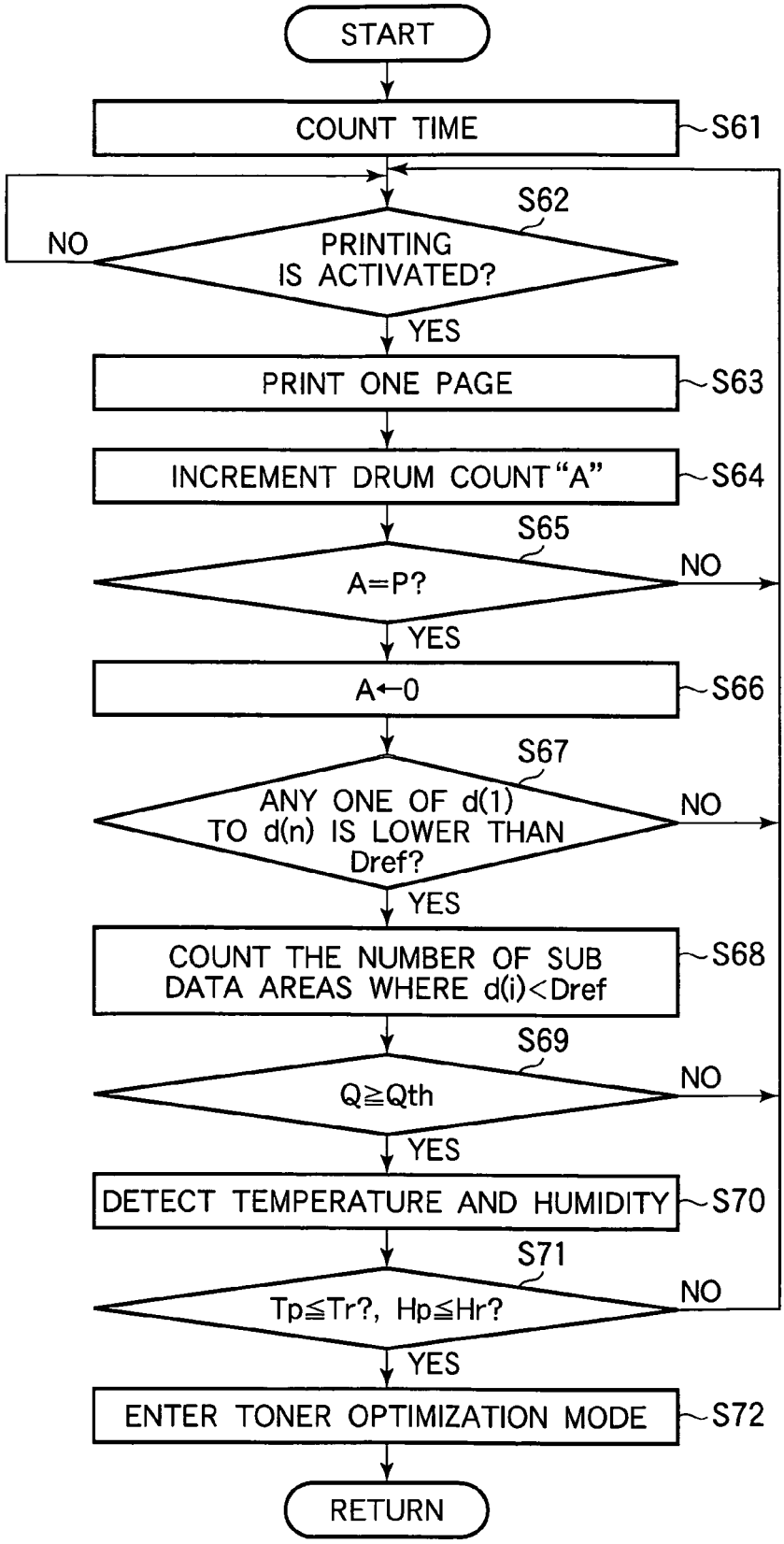
FIG. 19 is a flowchart illustrating the operation of the printer of the sixth embodiment.

FIG. 19 is a flowchart illustrating the operation of the printer of the sixth embodiment.

The timer 51 (FIG. 18) is counting time. When a printing operation is activated, a print controller 41 performs printing on one page of print paper. A drum counter 49 (FIG. 16) increments a drum count A as the photoconductive drum 14 rotates.

Subsequently, a drum count monitor 40*a* makes a decision to determine whether the drum count A has reached a threshold value P. If the drum count A has reached a threshold value P, the drum count monitor 40*a* clears the drum count A.

The computing sections Cd(1), Cd(2), Cd(3), . . . , Cd(i), . . . , Cd(n) compute the dot population densities d(1), d(2), d(3), d(i), . . . , d(n) based on the drum count A and the dot counts in the sub data areas m(1), m(2), m(3), . . . , m(i), . . . , m(n), respectively.

A subtracting section 44*a* in the comparing section 44 compares the reference density Dref with the dot population densities d(1), d(2), . . . , d(i), . . . d(n), respectively, thereby counting the number of sub data areas, Q in which the dot population density is lower than the reference density Dref.

Subsequently, a decision section 40*g* of a controller 40 makes a decision to determine whether the number of sub data areas, Q is not smaller than a threshold value Qth. Since the threshold value Qth never exceeds the maximum number of sub data areas n, the following relation exists.

$$Qth \leqq n$$

In the fourth embodiment, the threshold value Qth is selected to be n/2. The comparing section 44 and the decision section 40*g* cooperate with each other to determine whether the toner on the developing roller 17 should be discarded.

The controller 40 makes a decision to determine whether a detected temperature Tp is not lower than a reference temperature Tr and whether a detected humidity Hp is not higher than a reference humidity Hr. If Tp>Tr and Hp>Hr, then a toner optimization mode is entered.

As described above, the toner optimization mode is entered only when the temperature and humidity inside of the printer are lower than predetermined references, so that the toner optimization mode is not entered more frequently than necessary.

The flowchart in FIG. 19 will be described.

Step S61: The timer 51 counts time.

Step S62: The program waits for activation of a printing operation. When a printing operation is activated, the program proceeds to step S63.

Step S63: Printing is performed on one page of print paper.

Step S64: The drum count A is incremented.

Step S65: A check is made to determine whether the drum count A is equal to the threshold value P. If the drum count A is equal to the threshold value P, then the program proceeds to step S66. If the drum count A is not equal to the threshold value P, then the program jumps back to step S62.

Step S66: The drum count A is reset.

Step S67: A check is made to determine whether any one of the dot population densities d(1) to d(n) is lower than the reference density Dref. If any one of the dot population densities d(1) to d(n) is lower than the reference density Dref, then the program proceeds to step S68. If all of the dot population densities d(1) to d(n) are equal to or larger than the reference density Dref, then the program proceeds to step S62.

Step S68: The comparing section 44 counts the number of sub data areas, Q, in which the dot population density is lower than the reference density Dref.

Step S69: The decision section 40*g* makes a decision to determine whether the number of sub data areas, Q is not smaller than the threshold value Qth. If Q≧Qth, the program proceeds to step S70. If Q<Qth, then the program jumps back to step S62.

Step S70: The temperature and humidity detecting section 50 detects the temperature Tp and humidity Hp inside of the printer.

Step S71: The controller 40 makes a decision to determine whether Tp>Tr and Hp>Hr. If Tp≦Tr and Hp≦Hr, then the program proceeds to step S72. If Tp>Tr and Hp>Hr, the program jumps back to step S62.

Step S72: The toner optimization mode is entered.

While the first to sixth embodiments have been described in terms of a printer, the present invention may also be applied to a copying machine, a facsimile machine, and an MFP (multi function printer).

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an image bearing body on which an image is formed in accordance with image data;

a developer bearing member that supplies a developer material to the image bearing body;

a developer supplying member that supplies the developer material to the developer bearing member;

a computing section that computes a dot population density for a corresponding one of a plurality of sub data areas, the plurality of sub data areas being obtained by dividing the image data such that the plurality of sub data areas are aligned in a printable area of a print medium in a direction perpendicular to a direction of travel of the print medium;

a controller that performs a developer material removing process based on the dot population density, the developer material removing process being such that the developer material deposited on the developer bearing member is removed from the developer bearing member in an area corresponding to the dot population density, wherein the controller performs the developer material removing process when the dot population density is lower than a reference value; and a print controller that generates a print pattern, wherein when a dot population density of a sub data area is lower than the reference value, said print controller generates the print pattern for printing an additional number of dots equal to the number of dots required for the dot population density of the sub data area to be equal to the reference value, and when the controller performs the developer material removing process, the print controller prints the print pattern.

2. The image forming apparatus according to claim 1, wherein the computing section computes the dot population density based on a number of printed dots in the corresponding one of the plurality of sub data areas and a number of printable dots in the corresponding one of the plurality of sub data areas.

3. The image forming apparatus according to claim 2, wherein the dot population density is the ratio of the number of printed dots to the number of printable dots.

4. The image forming apparatus according to claim 1, further comprising an environmental condition detecting section that detects an environmental condition inside of the image forming apparatus, wherein the controller performs the developer material removing process in accordance with the environmental condition.

5. The image forming apparatus of claim 1, wherein the controller performs a subtraction between the dot population density and the reference density, then performs a developer material discarding process to discard the developer material in accordance with a difference between the dot population density and the reference density.

6. An image forming apparatus, comprising:

an image bearing body on which an image is formed in accordance with image data;

a developer bearing member that supplies a developer material to the image bearing body to form a developer image;

a developer supplying member that supplies the developer material to the developer bearing member;

a computing section that computes a dot population density for a corresponding one of a plurality of sub data areas, the plurality of sub data areas being obtained by dividing the image data such that the plurality of sub data areas are aligned in a printable area of a print medium in a direction perpendicular to a direction of travel of the print medium;

a controller that performs a developer material discarding process based on the dot population density, the developer material discarding process being such that the developer material is discarded from the developer bearing member to the image bearing body, the developer material being discarded from the developer bearing member in an area corresponding to the dot population density, wherein the controller performs the developer material discarding process when the dot population density is lower than a reference value; and a print controller that generates a print pattern, wherein when a dot population density of a sub data area is lower than the reference value, said print controller generates the print pattern for printing an additional number of dots equal to the number of dots required for the dot population density of the sub data area to be equal to the reference value, and when the controller performs the developer material discarding process, the print controller prints the print pattern.

7. The image forming apparatus according to claim 6, further comprising an environmental condition detecting section that detects an environmental condition interior of the image forming apparatus is placed, wherein the controller performs the developer material discarding process in accordance with the environmental condition.

8. The image forming apparatus according to claim 6, wherein the controller performs the developer material discarding process to discard the developer material in accordance with a difference between the dot population density and the reference value.

9. The image forming apparatus according to claim 6, wherein the computing section computes the dot population density based on a number of printed dots in the corresponding one of the plurality of sub data areas and a number of printable dots in the corresponding one of the plurality of sub data areas.

10. The image forming apparatus according to claim 9, wherein the dot population density is the ratio of the number of printed dots to the number of printable dots.

11. The image forming apparatus of claim 6, wherein the controller performs a subtraction between the dot population density and the reference density, then performs the developer material discarding process to discard the developer material in accordance with a difference between the dot population density and the reference density.

12. An image forming apparatus, comprising:

an image bearing body in which an image is formed in accordance with image data;

a developer bearing member to which a first potential of a first polarity is applied, the developer bearing member supplying a developer material to the image bearing body to form a developer image;

a developer supplying member to which a second potential of a second polarity is applied, the developer supplying member supplying the developer material to the developer bearing member, the first and second polarities being the same;

a computing section that computes a dot population density for a corresponding one of a plurality of sub data areas, the plurality of sub data areas being obtained by dividing the image data such that the plurality of sub data areas are aligned in a printable area of a print medium in a direction perpendicular to a direction of travel of the print medium; and a controller that decreases a potential difference between the first potential and the second potential based on the dot population density.

13. The image forming apparatus according to claim 12, wherein the computing section computes the dot population density based on a number of printed dots in a corresponding one of the plurality of sub data areas and a number of printable dots in the corresponding one of the plurality of sub data areas.

14. The image forming apparatus according to claim 13, wherein the controller decreases the potential difference when the dot population density is lower than a reference value.

15. The image forming apparatus according to claim 13, wherein when no printing is being performed, the controller decreases the potential difference in accordance with a number of sub data areas in which the dot population density is lower than a reference value.

16. The image forming apparatus according to claim 13, wherein when no printing is being performed, the controller sets the decreased potential difference smaller when a printing operation is not being performed than when the printing operation is being performed.

17. The image forming apparatus according to claim 12, further comprising an environmental condition detecting section that detects an environmental condition inside of the image forming apparatus, wherein the controller performs the developer discarding process in accordance with the environmental condition.

* * * * *